US010695831B2

(12) United States Patent
Maye et al.

(10) Patent No.: US 10,695,831 B2
(45) Date of Patent: Jun. 30, 2020

(54) METHOD TO CONTROL VOID FORMATION IN NANOMATERIALS USING CORE/ALLOY NANOPARTICLES WITH STAINLESS INTERFACES

(71) Applicants: Mathew M. Maye, Binghamton, NY (US); Wenjie Wu, Pleasanton, CA (US)

(72) Inventors: Mathew M. Maye, Binghamton, NY (US); Wenjie Wu, Pleasanton, CA (US)

(73) Assignee: Syracuse University, Syracuse, NY (US)

( * ) Notice: Subject to any disclaimer, the term of this patent is extended or adjusted under 35 U.S.C. 154(b) by 455 days.

(21) Appl. No.: 15/432,452

(22) Filed: Feb. 14, 2017

(65) Prior Publication Data

US 2017/0165749 A1 Jun. 15, 2017

Related U.S. Application Data

(63) Continuation of application No. 14/207,872, filed on Mar. 13, 2014, now Pat. No. 9,604,281.

(60) Provisional application No. 61/779,464, filed on Mar. 13, 2013.

(51) Int. Cl.

| | |
|---|---|
| ***B22F 1/02*** | (2006.01) |
| ***B22F 1/00*** | (2006.01) |
| ***B22F 9/24*** | (2006.01) |
| ***B22F 9/30*** | (2006.01) |

(52) U.S. Cl.

CPC ..... *B22F 1/025* (2013.01); *B22F 1/0018* (2013.01); *B22F 1/0085* (2013.01); *B22F 1/02* (2013.01); *B22F 9/24* (2013.01); *B22F 9/305* (2013.01); *B22F 2998/10* (2013.01); *Y10T 428/12181* (2015.01)

(58) Field of Classification Search

CPC ..... B22F 2001/0029

See application file for complete search history.

(56) References Cited

U.S. PATENT DOCUMENTS

2010/0258759 A1* 10/2010 Archer ..... B82Y 30/00 252/62.56

2013/0078510 A1* 3/2013 Reynolds ..... B82Y 30/00 429/209

* cited by examiner

*Primary Examiner* — Adam Krupicka

(74) *Attorney, Agent, or Firm* — Bond Schoeneck and King PLLC; David Nocilly

(57) ABSTRACT

The present invention describes the use of nanoparticle interfaces to chemically process solid nanomaterials into ones with tailorable core-void-shell architectures. The internal void sizes are proportional to the nanoparticle size, the shell thickness and composition, and can be either symmetric or asymmetric depending on the nature of the interface, each of which is controlled by the process of making.

13 Claims, 28 Drawing Sheets

METHOD TO CONTROL VOID FORMATION IN NANOMATERIALS USING CORE/ALLOY NANOPARTICLES WITH STAINLESS INTERFACES

CROSS-REFERENCE TO RELATED APPLICATIONS

This application is a continuation of U.S. application Ser. No. 14/207,872, filed on Mar. 13, 2014, which claimed priority to U.S. Provisional Application No. 61/779,464, filed on Mar. 13, 2013.

BACKGROUND OF THE INVENTION

1. Field of the Invention

The present invention relates to nanoscience, nanoparticles and, more specifically, to a highly uniform, table, and tailorable core-void-shell morphology.

2. Description of the Related Art

Stainless metal interfaces resist bulk oxidation and consist of FeCr alloys. This stainless characteristic is the result of an oxidation process in which a passivating layer of $Cr_2O_3$ forms which limits further molecular oxygen transport. Like bulk materials, the oxidation of nanomaterials is a critically important phenomenon the extent of which determines the materials function. This is especially true for first row transition metals. While the synthesis of oxide nanomaterials is well established, approaches to resist oxidation are varied, and recent studies have in turn welcomed oxidation as a synthetic tool to manipulate nanoparticle morphology and microstructure.

Oxidation in iron based nanostructures lead to Kirkendall diffusion, which can form an assortment of hollow nanostructures, ranging from nanowires on a solid support, to nanocubes, and nanospheres. The experimental implementation of Kirkendall diffusion using Co nanoparticles (NPs), upon sulfidation of solid Co NPs, showed well defined hollow morphologies that resulted in an assortment of $Co_xS_y$ phases. It was further shown that the sulfidation of Pt/Co core/shell NPs resulted in novel core-void-shell morphologies, due in large part to the resistance of the Pt core to oxidation.

These examples of 'vacancy coalescence' have since prepared a number of hollow nanostructures, like Fe, $Fe_3O_4$, Co, Ni and Cd NPs. Vacancy coalescence can be considered an extension of the Kirkendall effect, when diffusion is confined to a three dimensional nanomaterial, and is the result of the nonreciprocal diffusion of materials within the NP, electrical contact between the core and shell, as well as defect concentration. Parameters that can tune this phenomena include the diffusivity of the atoms involved, the oxidation products, NP morphology, and the size of the starting material. To date little work has been described that uses alloy interfaces, or stainless materials, to control Kirkendall kinetics and void formation.

BRIEF SUMMARY OF THE INVENTION

The present invention employs a core/alloy NP synthesis route, inspired by work developed by the present inventors for $Au/Au_xAg_{1-x}/Ag$, $Au/Au_xAg_{1-x}$, $Au/Au_xPd_{1-x}$, and $Au/Au_xAg_{1-x}AgNPs$, to deposit sub-nanometer thin Cr shells at crystalline α-Fe NP cores, which upon annealing, results in $\alpha\text{-}Fe/Fe_xCr_{1-x}$ Core/Alloy NPs. The oxidation of these core/alloy NPs results in a core-void-shell morphology, in which the interior core remains crystalline and highly magnetic, while the FeCr oxide shell passivates further oxidation at modest temperatures up to ~200° C. The void formation is tunable based on the thickness of the Cr shell, with thicker shells resisting both bulk oxidation and void coalescence. The particles of the present invention show a unique morphological transformation that is induced by surface oxidation, oxide passivation, and vacancy coalescence. This Kirkendall diffusion results in a tailorable oxide layer thickness, Fe-core size, as well as void size and symmetry. Much like the interface of bulk stainless steel, the interfacial FeCr oxide passivates oxidation, resulting in self-limited diffusion. Because of this, a highly uniform and stable core-void-shell morphology is provided.

BRIEF DESCRIPTION OF THE SEVERAL VIEWS OF THE DRAWING(S)

The present invention will be more fully understood and appreciated by reading the following Detailed Description in conjunction with the accompanying drawings, in which.

Figure 3:
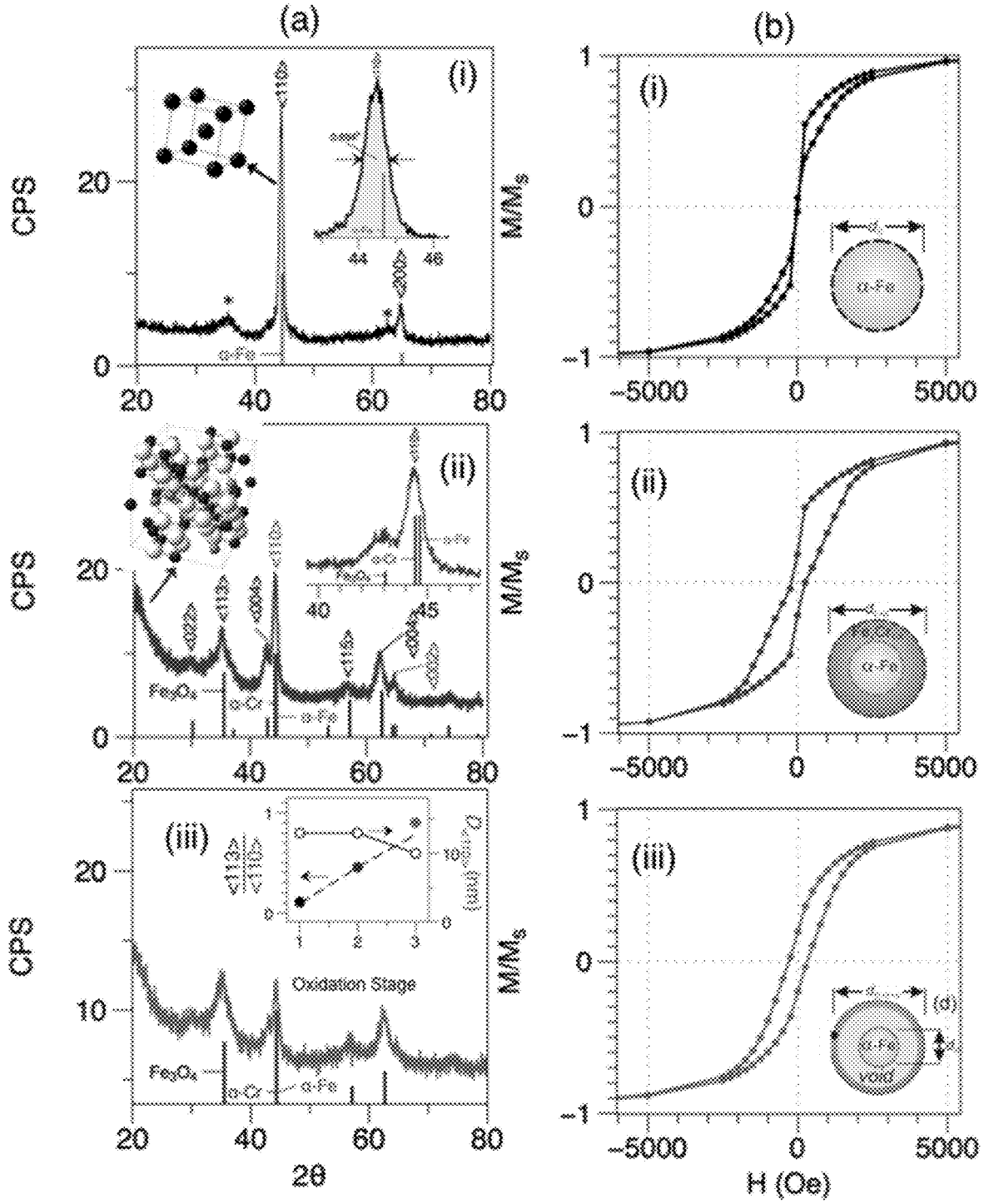
Figure 4:
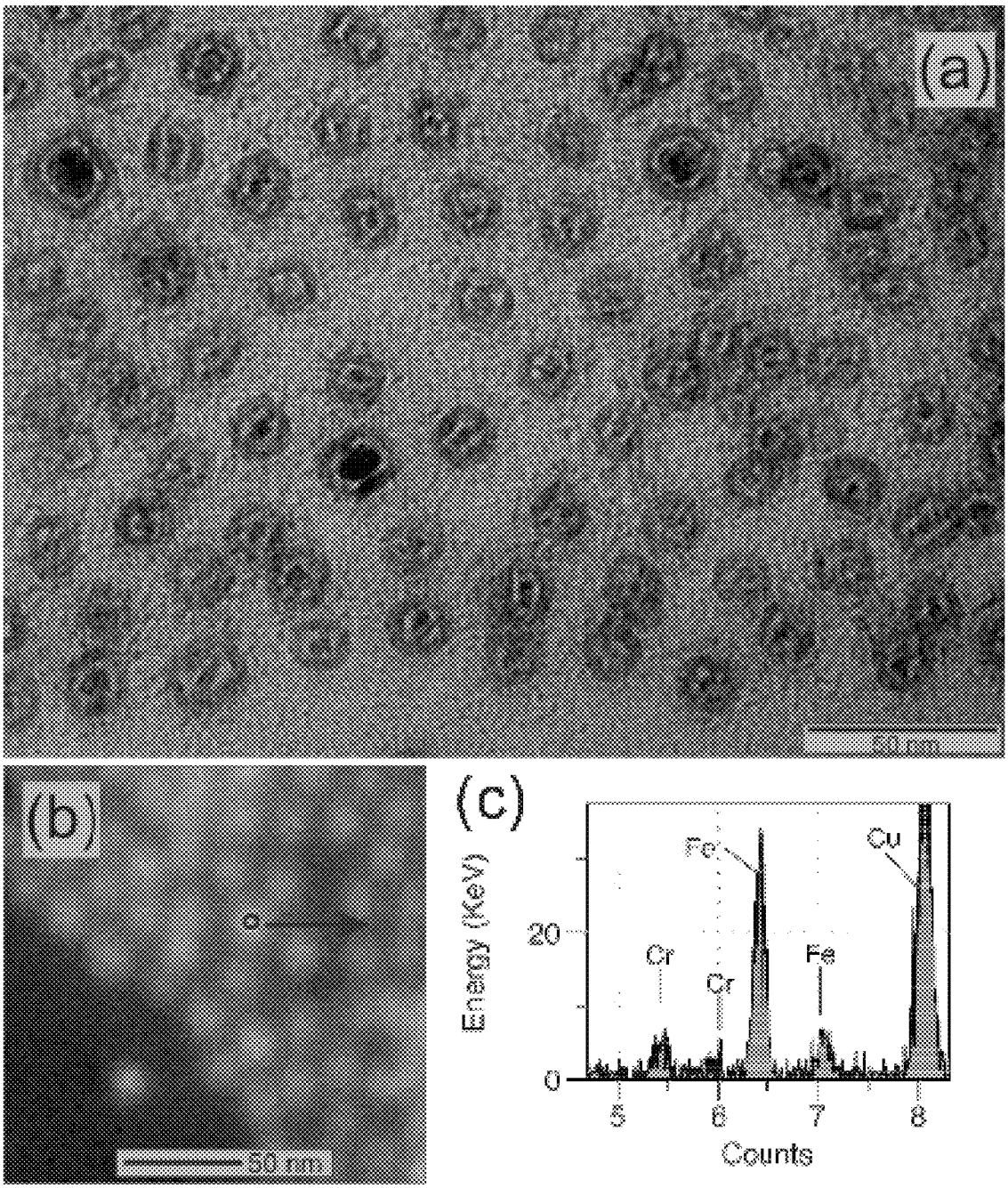
Figure 5A:
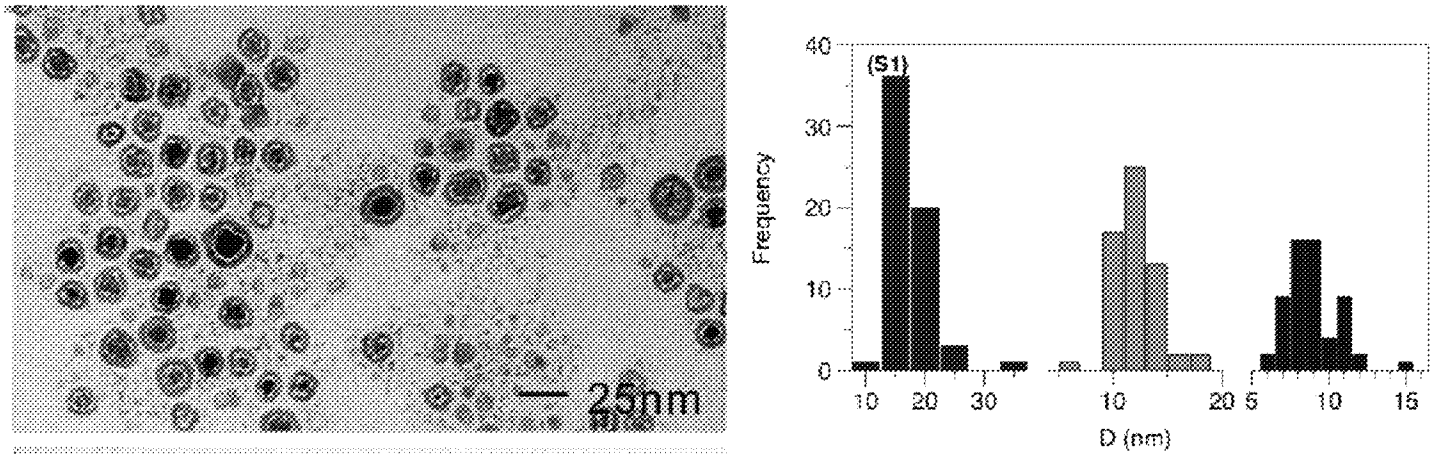
Figure 5B:
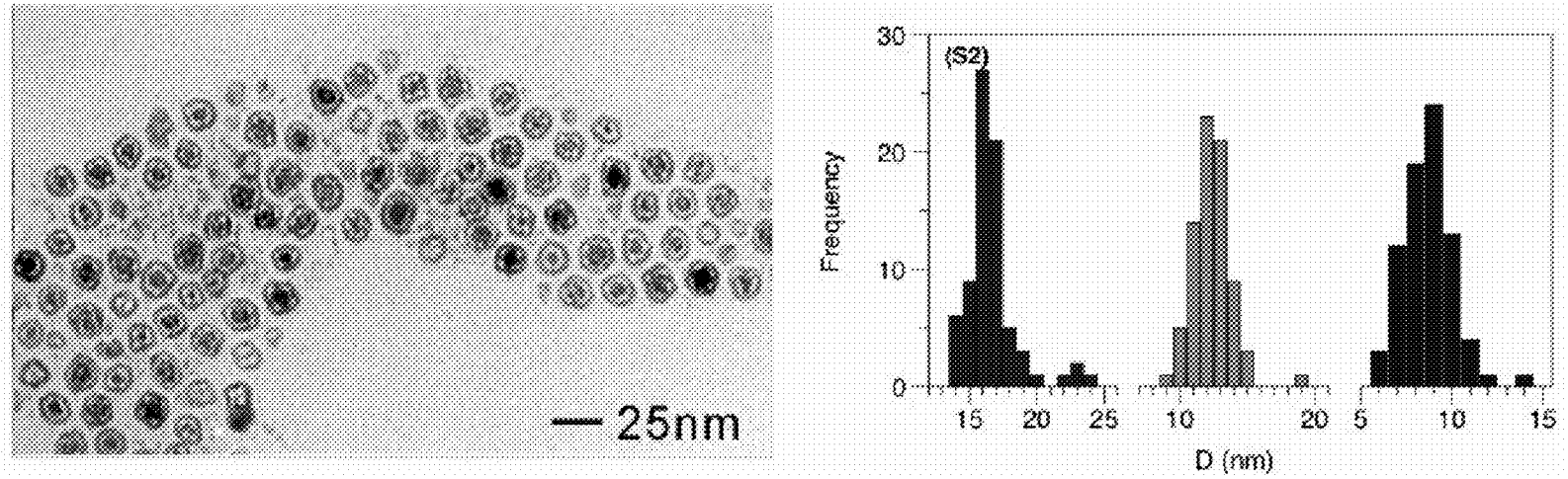
Figure 5C:
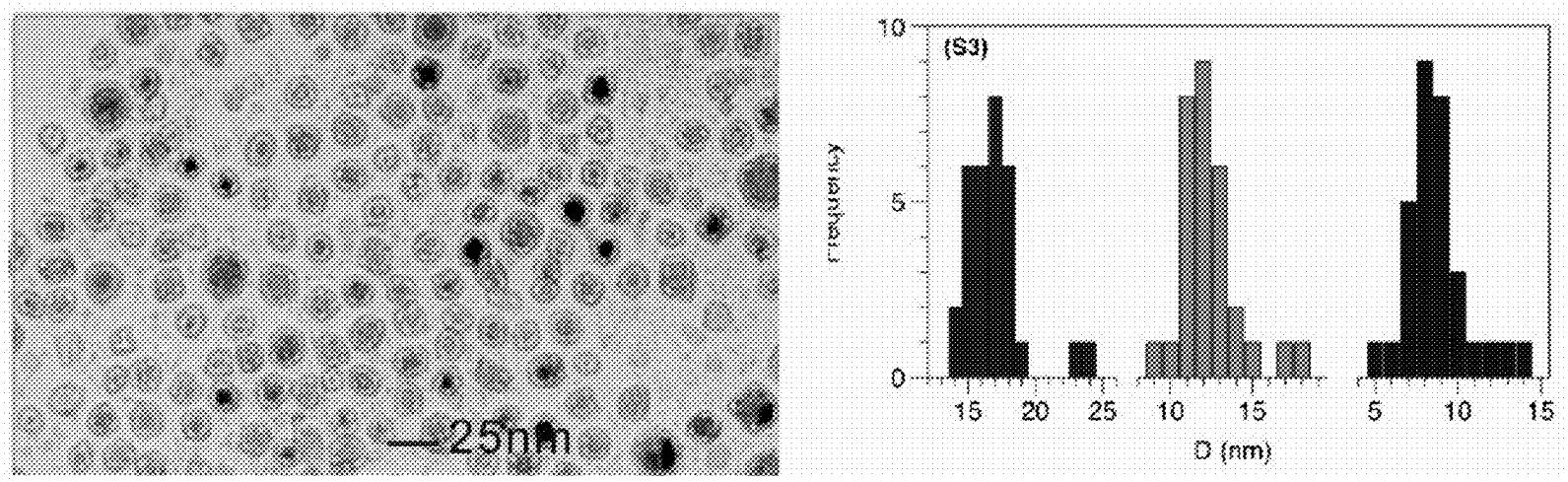
Figure 5D:
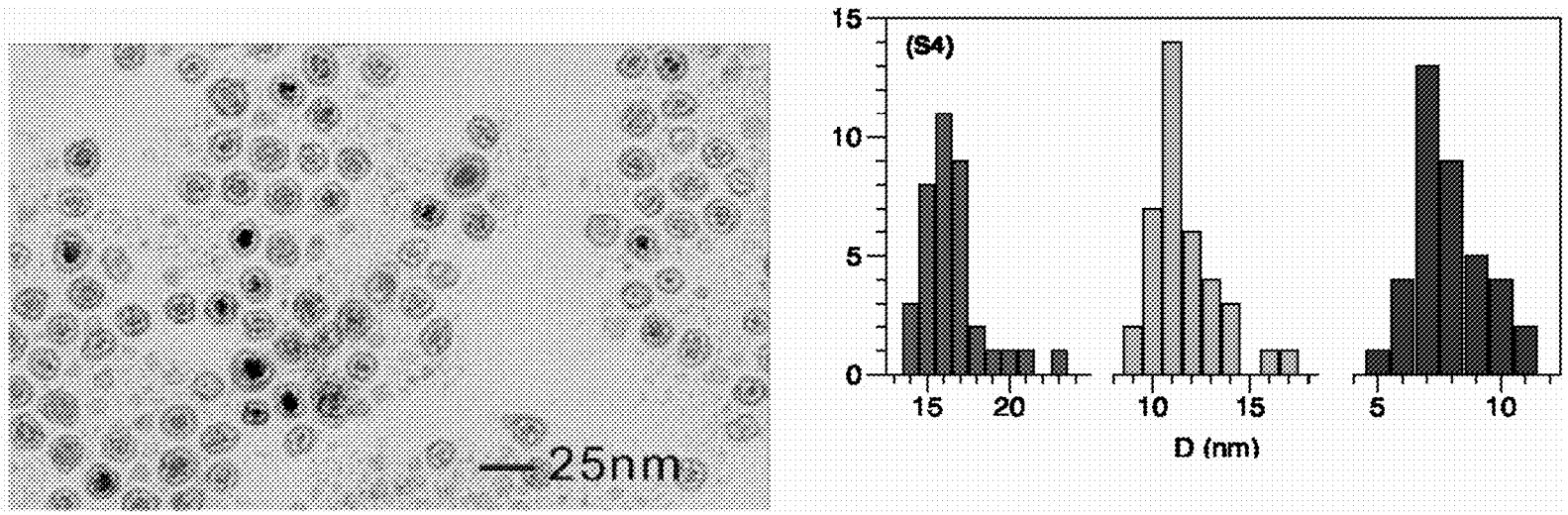
Figure 6:
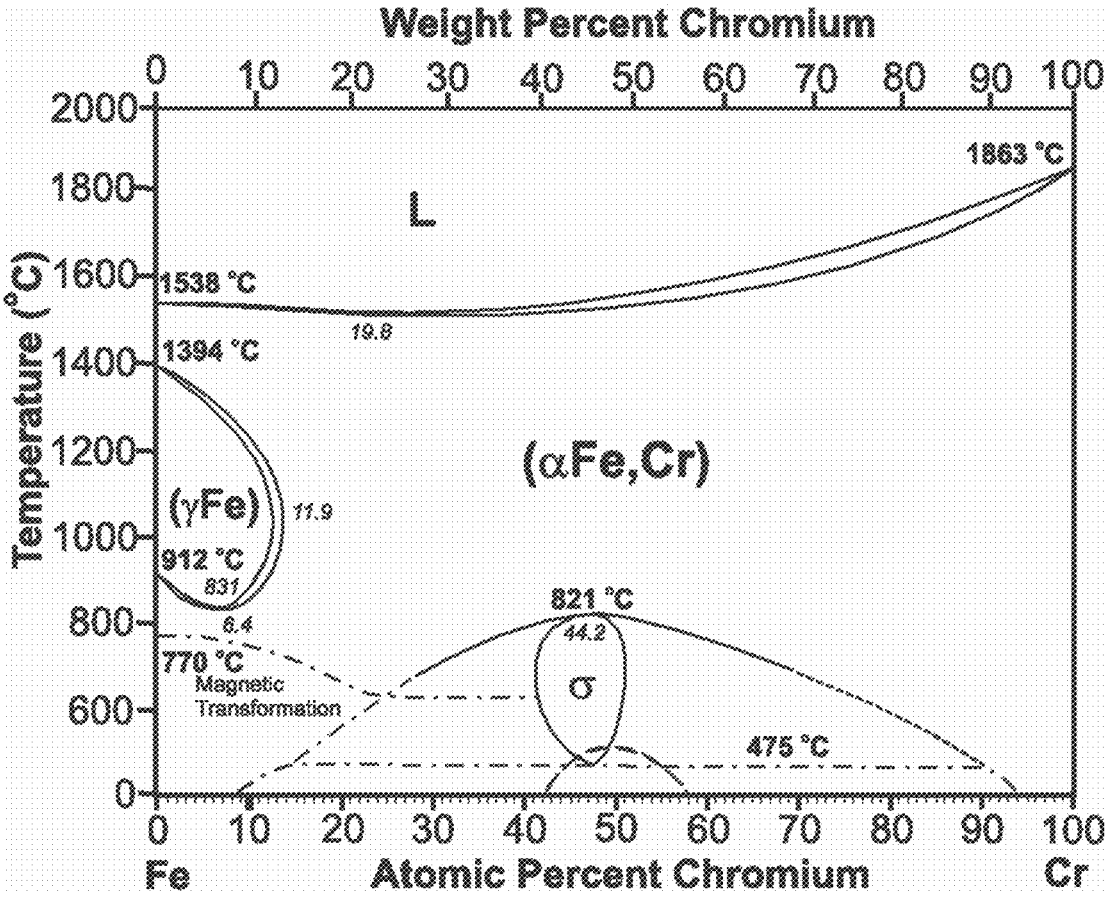
Figure 7:
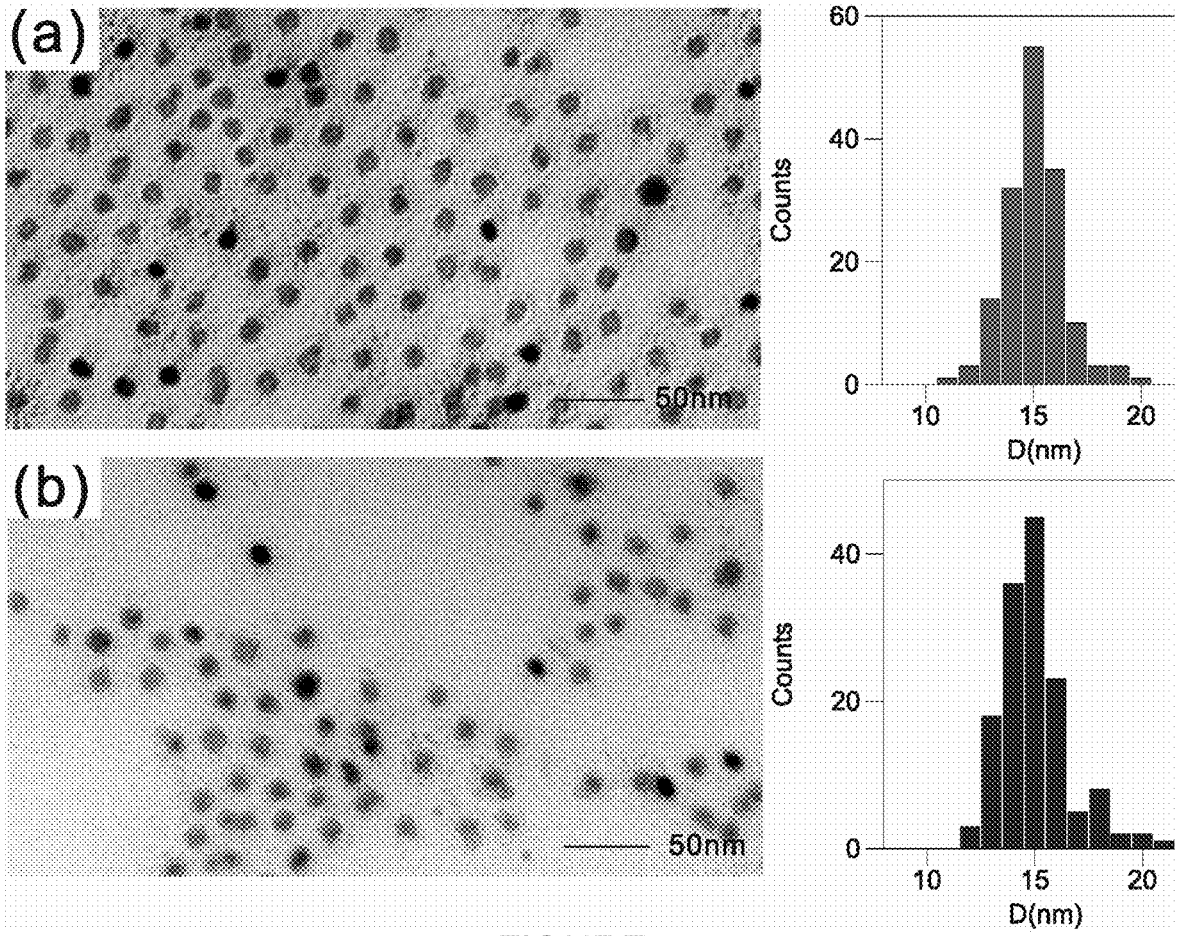
Figure 8A:
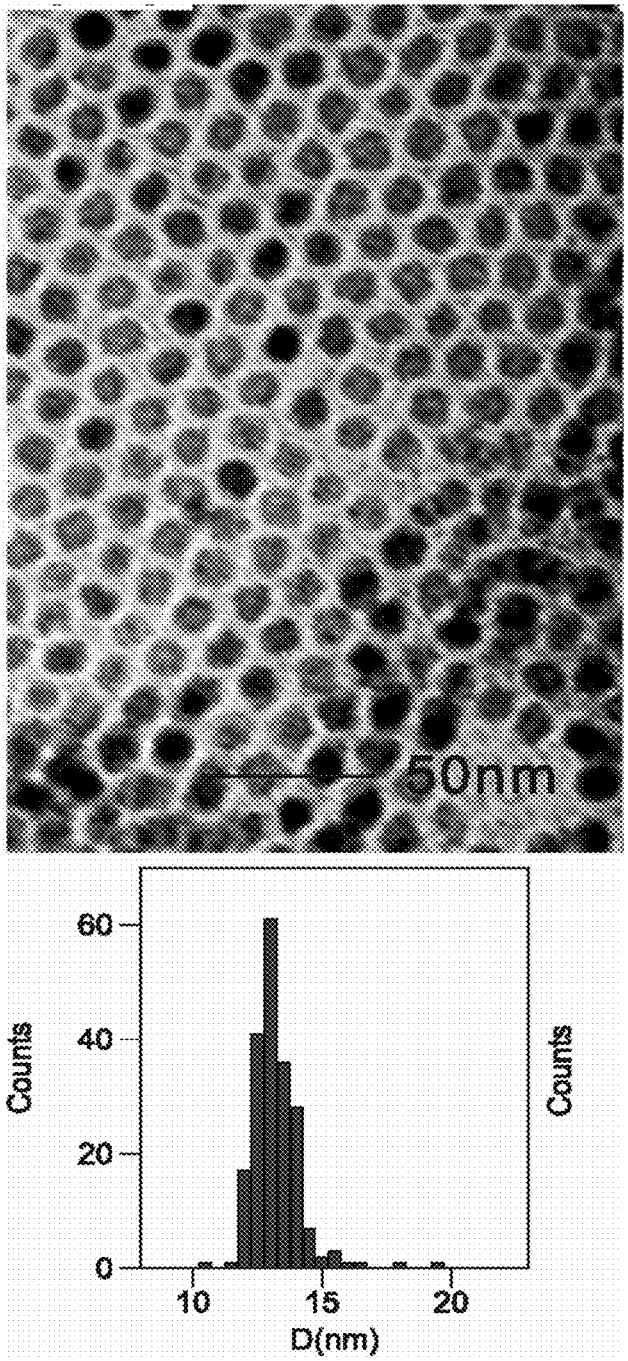
Figure 8B:
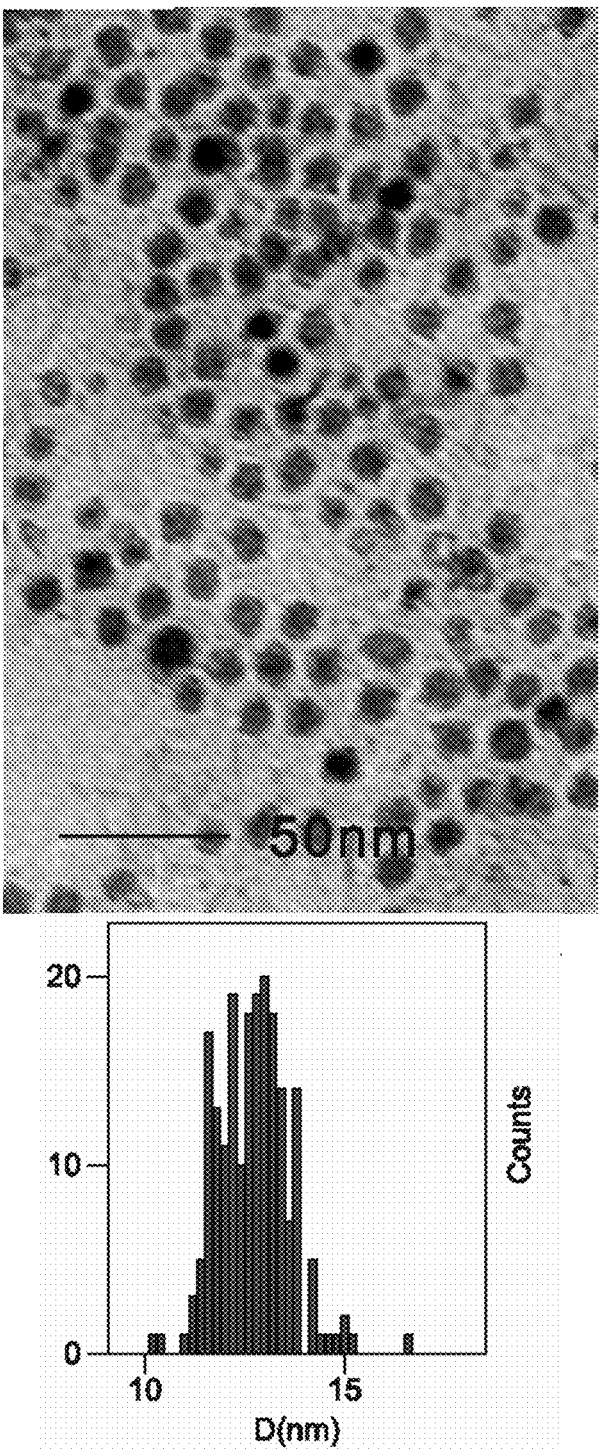
Figure 8C:
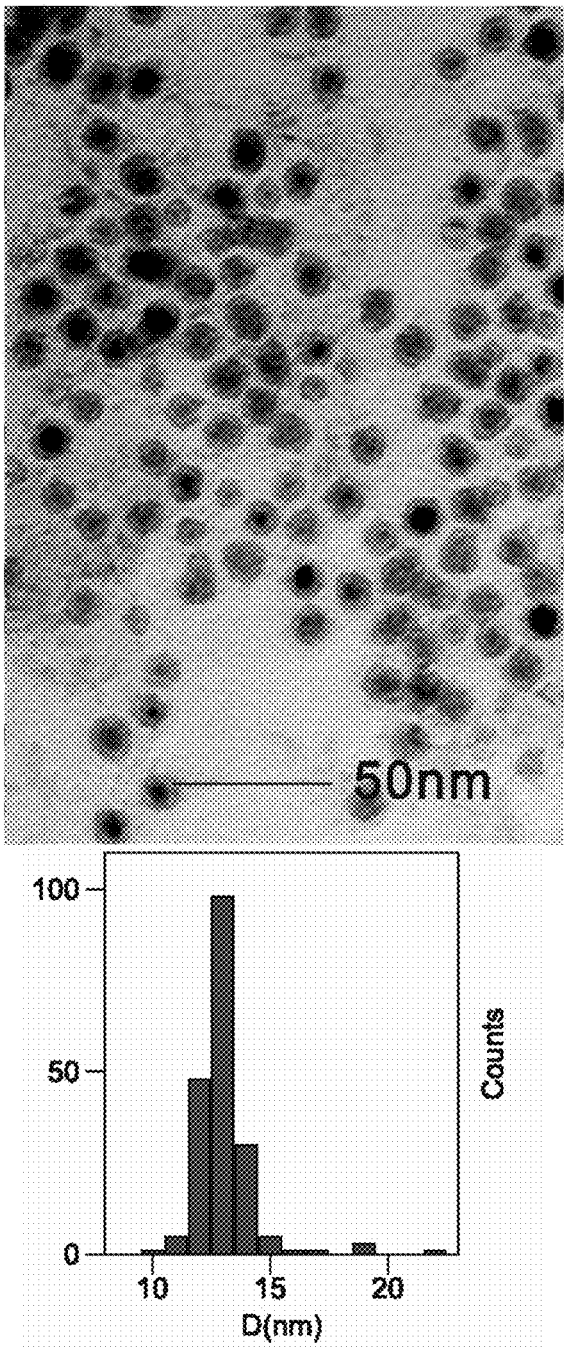
Figure 8D:
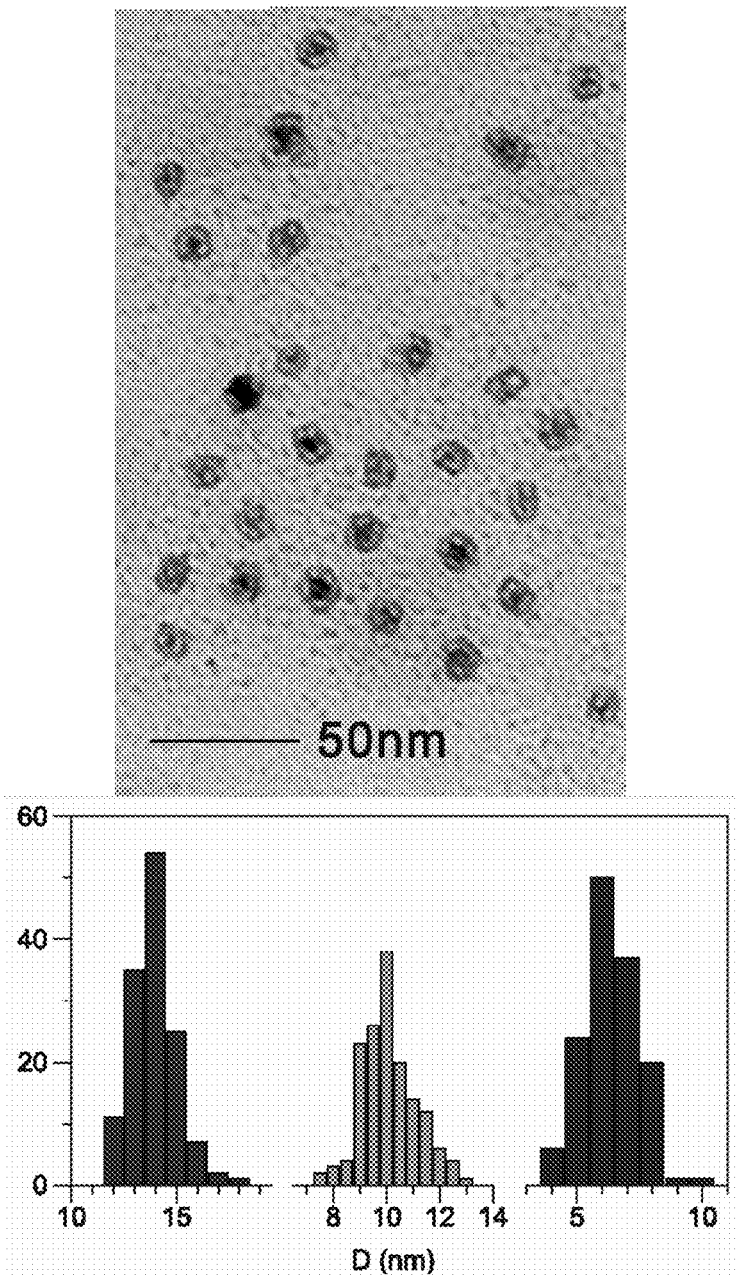
Figure 9:
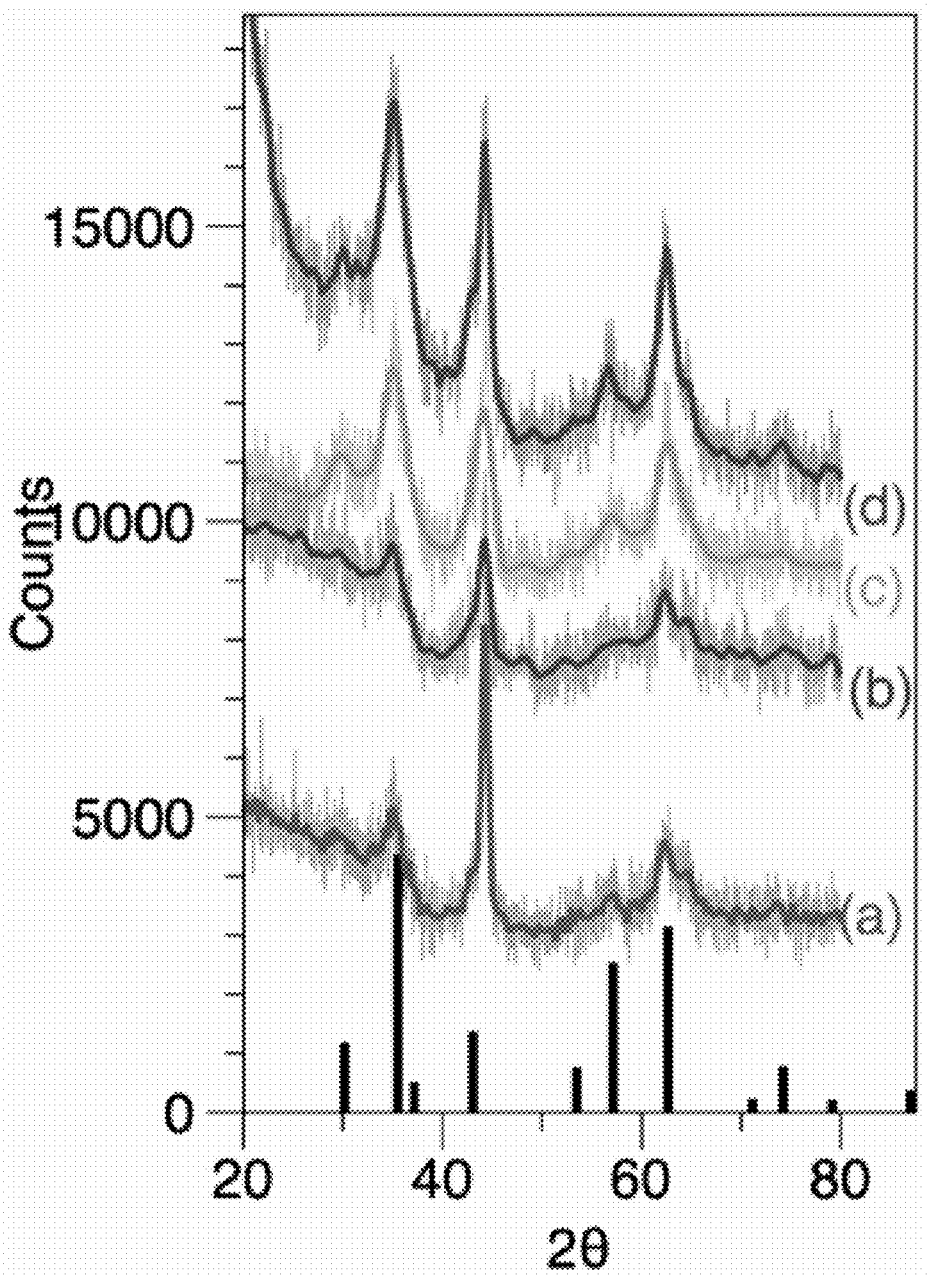
Figure 10:
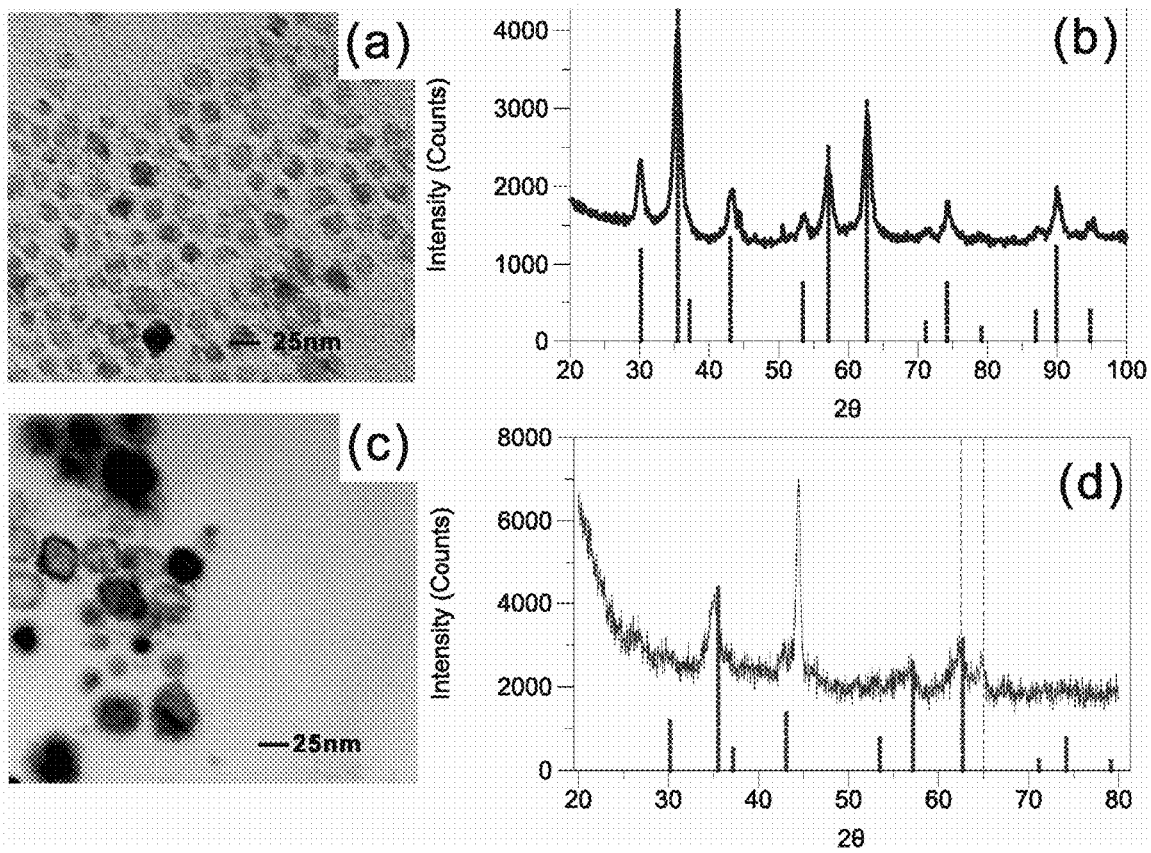
Figure 11:
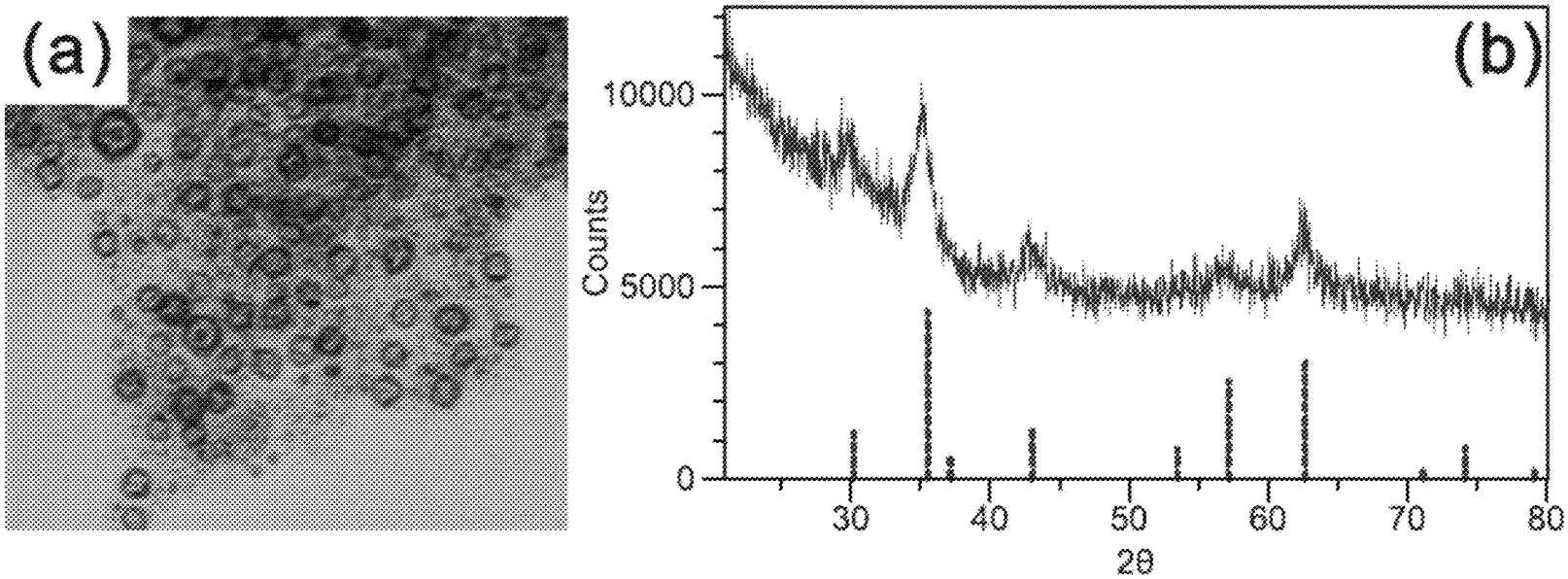
Figure 12A:
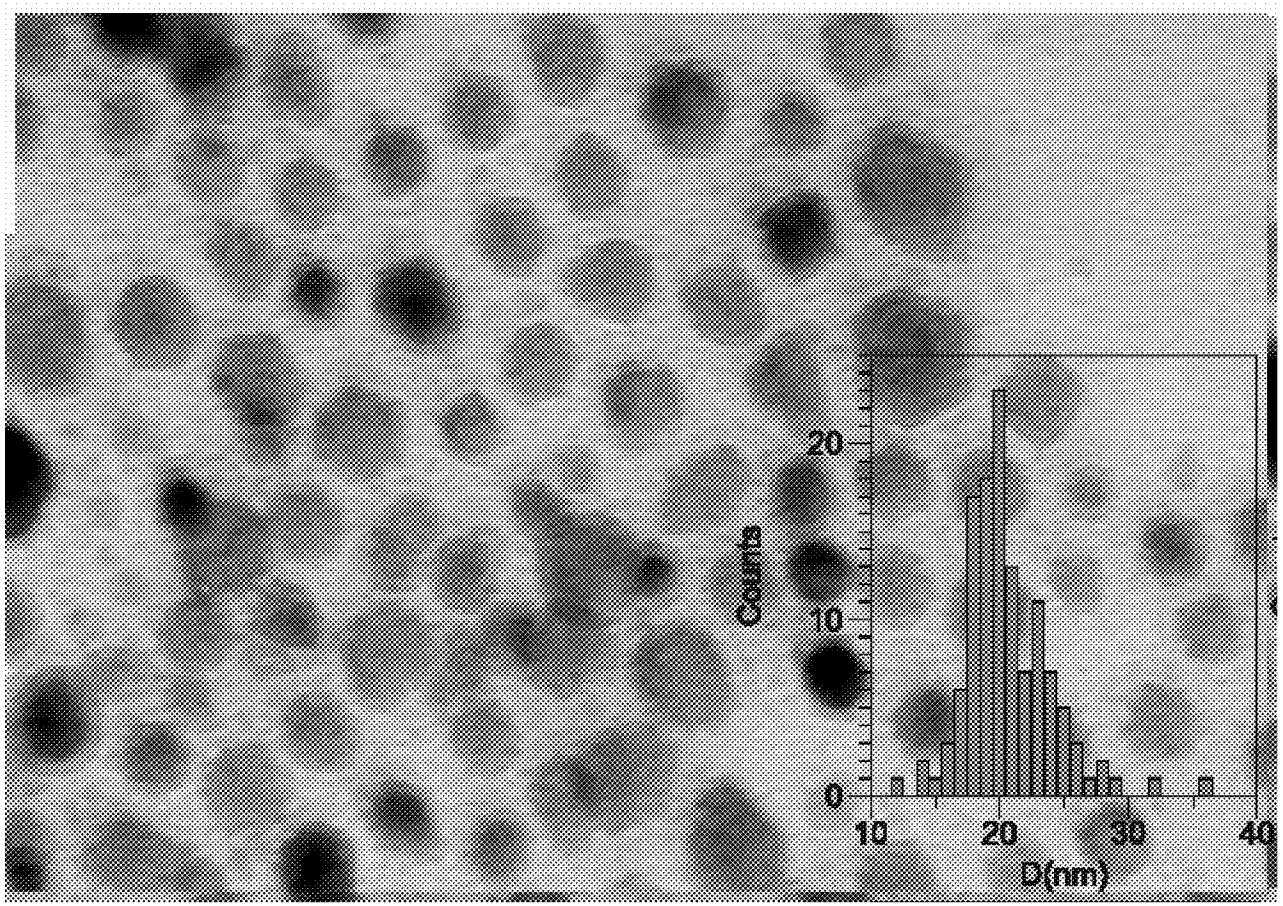
Figure 12B:
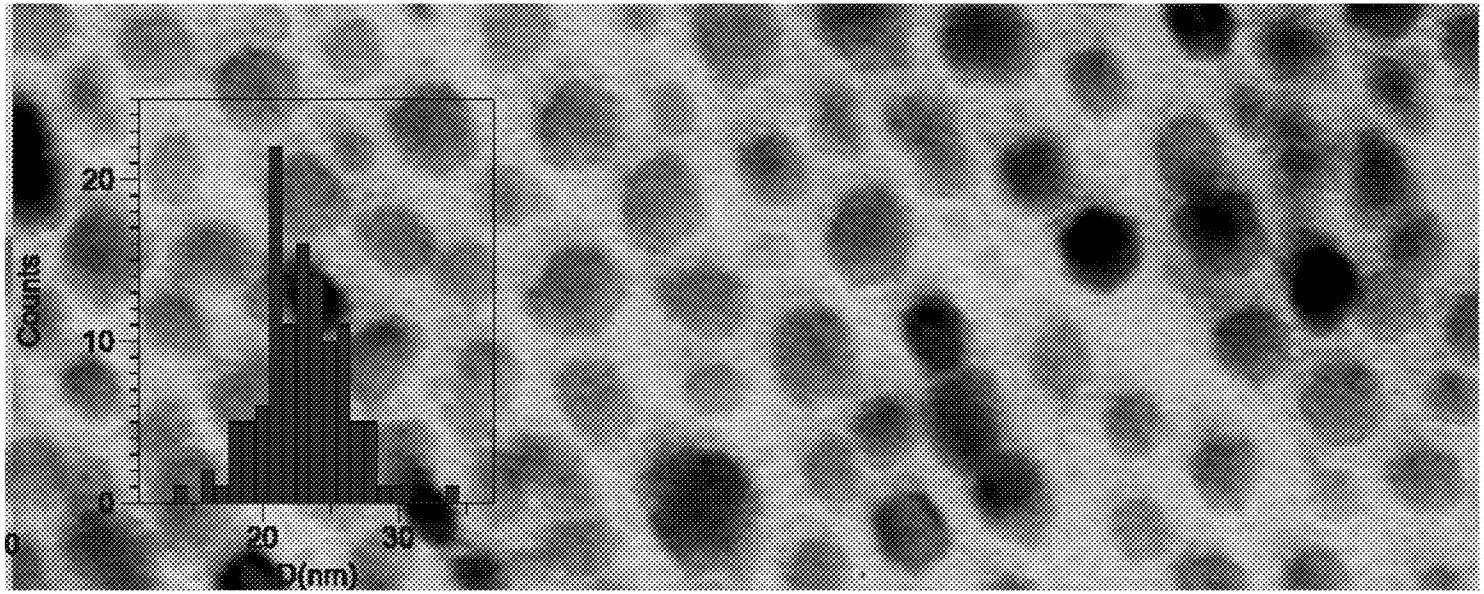
Figure 12C:
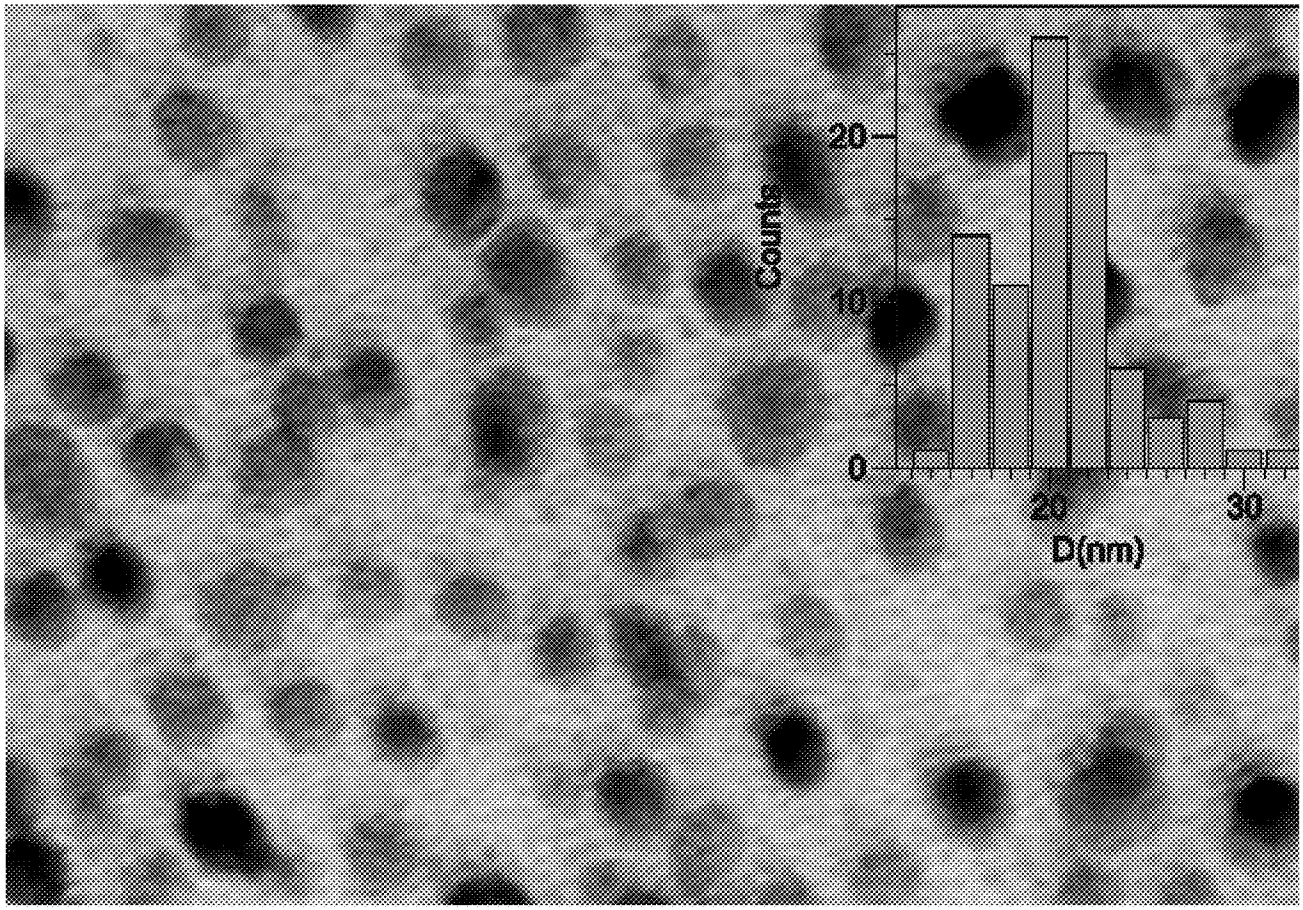
Figure 12D:
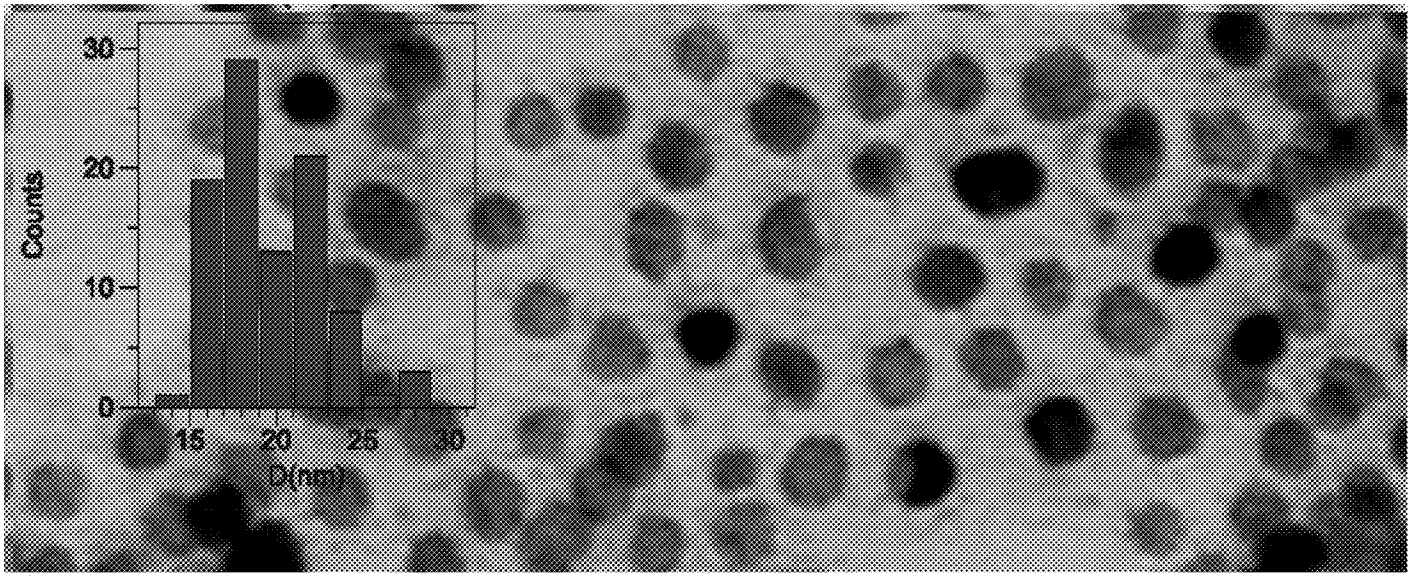
Figures 13A, 13B, 13C, 13D:
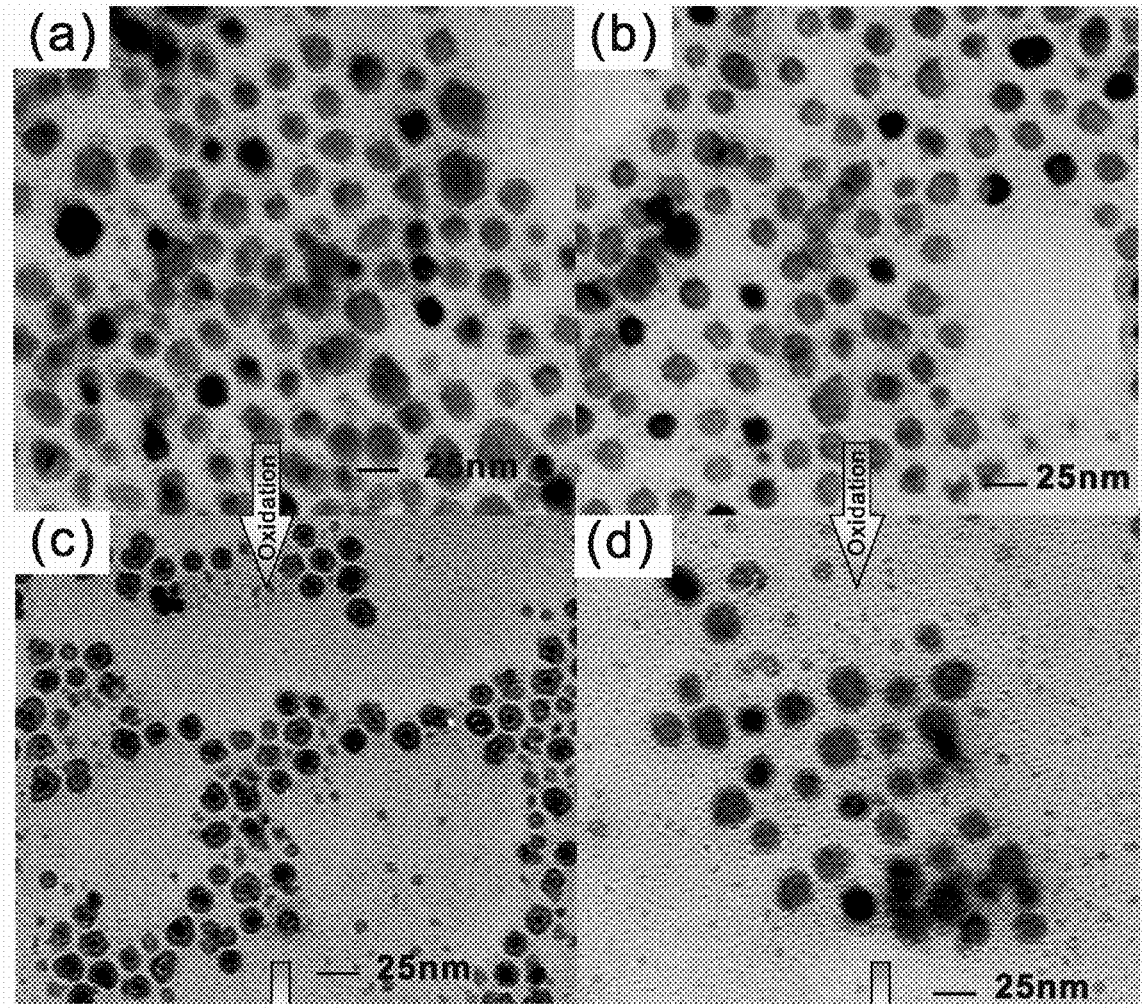
Figures 13E, 13F:
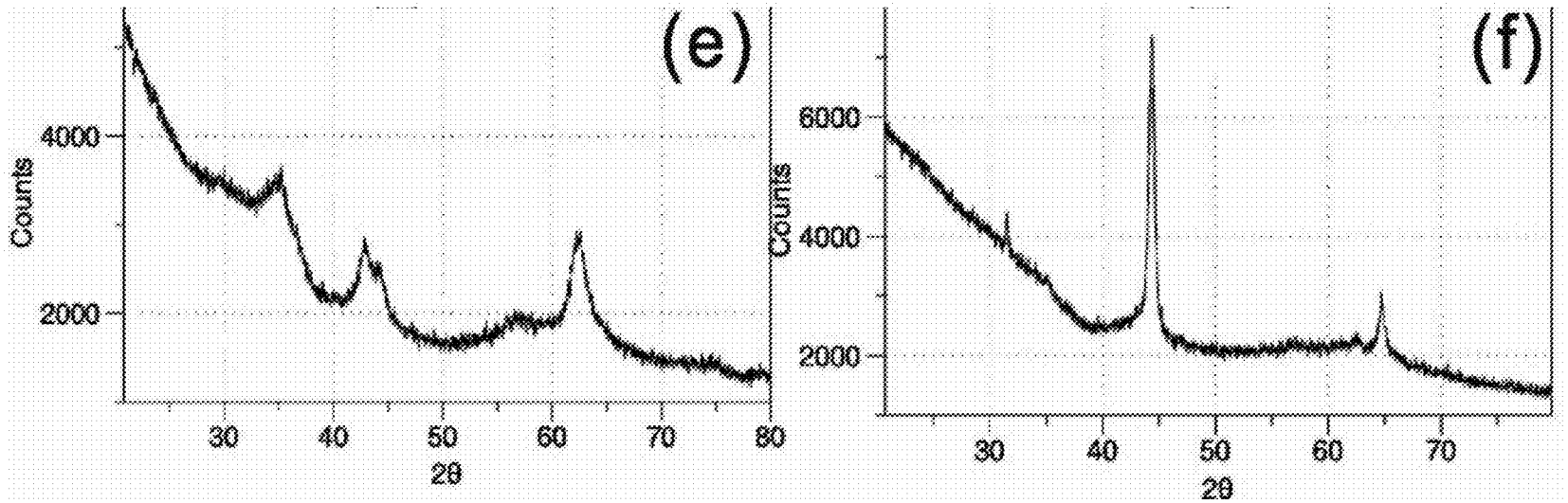

FIG. 3 is a series of graphs illustrating: (a) Powder XRD results for the α-Fe core (i), α-Fe/Cr (n=16) without extensive oxidation (ii), and after exposing to air with core-void-shell morphologies (iii), where the insets are focused regions of XRD and α-Fe and $FeCr_2O_4$ unit cells (i-ii), ratio of peak height from α-Fe<100> and $Fe_3O_4$<113> at oxidation states of core (1), core/alloy (2), and core-void-shell states (3); and (b) Corresponding magnetic susceptibility of the samples (i-iii) with the insets showing schematic illustration of particle morphologies with TEM determined dimensions;

FIG. 4 is a representative HRTEM of Fe/FeCr core-void-shell morphology after oxidation in ODE at T=100° C. for 12 h, where with the STEM results and EDX analysis of sample under highlighted region showing proof of FeCr makeup with composition of $Fe_{87}Cr_{13}$;

FIGS. 5A through 5D are a series of TEM micrographs of $Fe/Fe/Fe_xCr_{1-x}$ (n=16) NPs upon oxidation to core-void-shell morphologies at annealing times of 2.5 (a), 5.0 (b), 7.5 (c), and 10 h, along with corresponding statistical analysis of TEMs characterizing $_{dC'+S+V}$ (red), and $_{dC'}$ (blue);

FIG. 6 is a graph of the bulk FeCr binary phase diagram;

FIG. 7 is (a) a TEM of Fe/Cr n=16 without exposing to air ($_{dC+S}$=15.1±1.5 nm) after (b) exposure to air on TEM grid at room temperature ($_{dC'+V+S}$=15.0±1.6 nm);

FIGS. 8A through 8D are a series of representative TEM and the statistical analysis for (a) Fe core ($_{dC}$=13.2±1.0 nm); (b) Fe/Cr at n=8 without exposure to air ($_{dC+S}$=12.7±0.9 nm); (c) Fe/Cr n=8 after exposed to air on TEM grid at room temperature ($_{dC+S}$=13.1±1.3 nm), and (d) the same NP after oxidation at 100 $o_C$ in ODE for 10 h ($_{dC'}$=6.3±1.1 nm, $_{dC'+V+S}$=13.9±1.1 nm);

FIG. 9 is a an XRD for the α-Fe core (a), and $Fe/Fe_xCr_{1-x}$ (n=16) after oxidation at T=100° C. in ODE for 2.5 (b), 5.0 (c), and 7.5 hours (d);

FIG. 10 is a TEM micrograph (a) and powder XRD (b) of control experiment subjecting an amorphous Fe core to the same oxidation condition (air, T=100° C.) and same amount of time (10 h), compared to a TEM (c) and XRD (d) for the oxidation of an annealed and crystalline α-Fe, with the XRD compared to an $Fe_3O_4$ reference;

FIG. 11 is a final TEM (a) and XRD (b) for the oxidation of α-Fe/$Fe_xCr_{1-x}$ NPs at T=200° C., with the XRD compared to an $Fe_3O_4$ reference.

Figure 14:
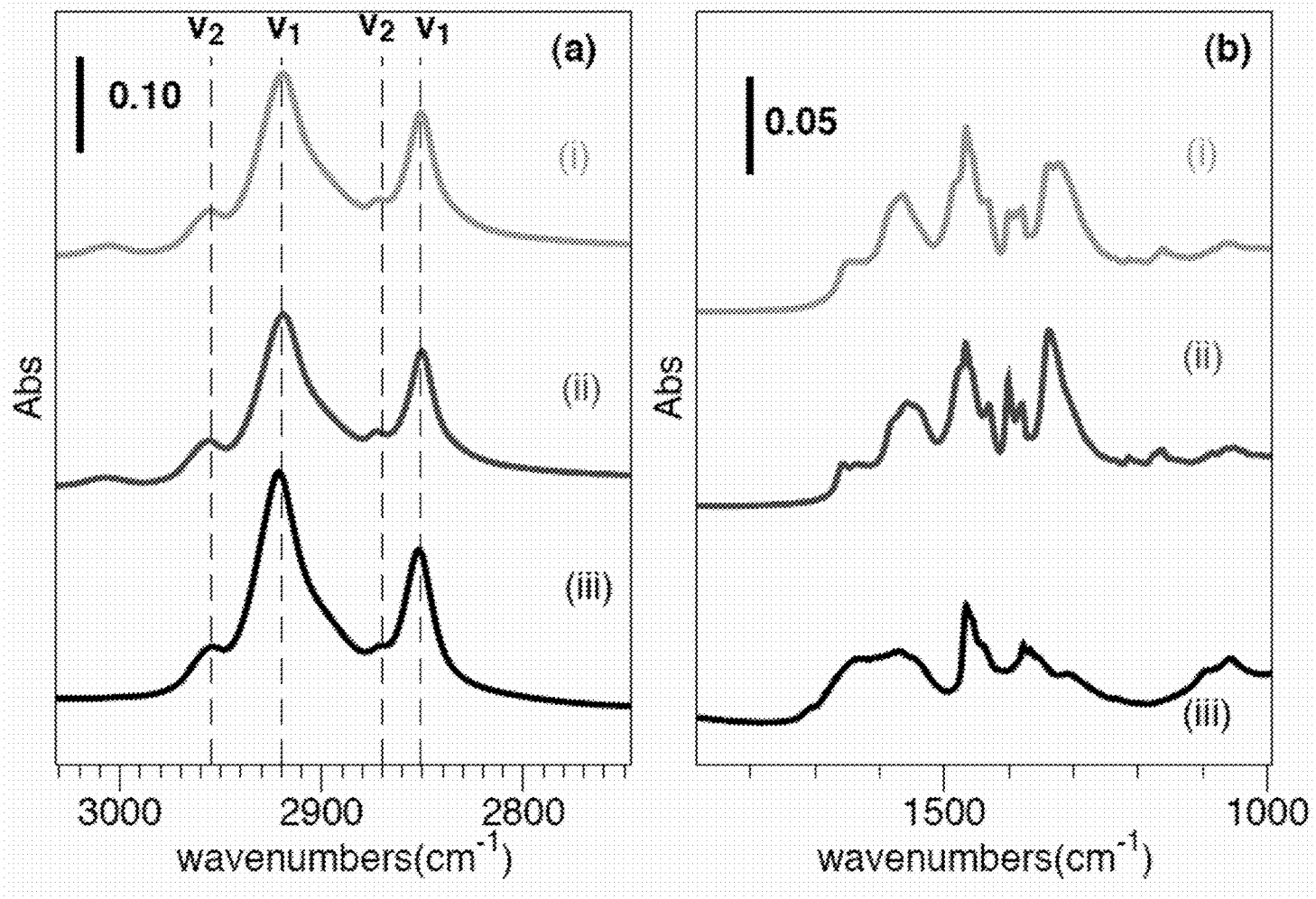

FIG. 12A through 12D are a series of TEM micrographs of Fe/$Fe_xCr_{1-X}$ NPs using $Cr(CO)_6$ dissolved in THF as the precursor at shell deposition cycles of n=4 (a, $_{dC+S}$=20.7±3.4 nm), n=8 (b, $_{dC+S}$=22.6±3.0 nm), n=12 (c, $_{dC+S}$=20.6±3.4 nm), and n=16 (d, $_{dC+S}$=19.8±3.7 nm), before oxidation;

FIGS. 13A through 13F are a series of Representative TEM micrographs of Fe/$Fe_XCr_{1-X}$ NPs at n=4 (a), and n=16 (b) that used THF as the solvent (see FIG. 10) before oxidation, and after oxidation (c), (d), with corresponding XRD after oxidation (e), (f), at T=100° C. for 5 h with the results indicating that the thicker Cr shell results in higher resistance to core-void-shell formation (i.e., TEM), and core oxidation (i.e., XRD);

FIG. 14 is a series of FT-IR spectra characterizing: (a) diluted Oleyamine and the ligand encapsulation for (b) and (c) as-synthesized FeCr NP, (d) Fe/$M_3O_4$ NP.

Figure 15:
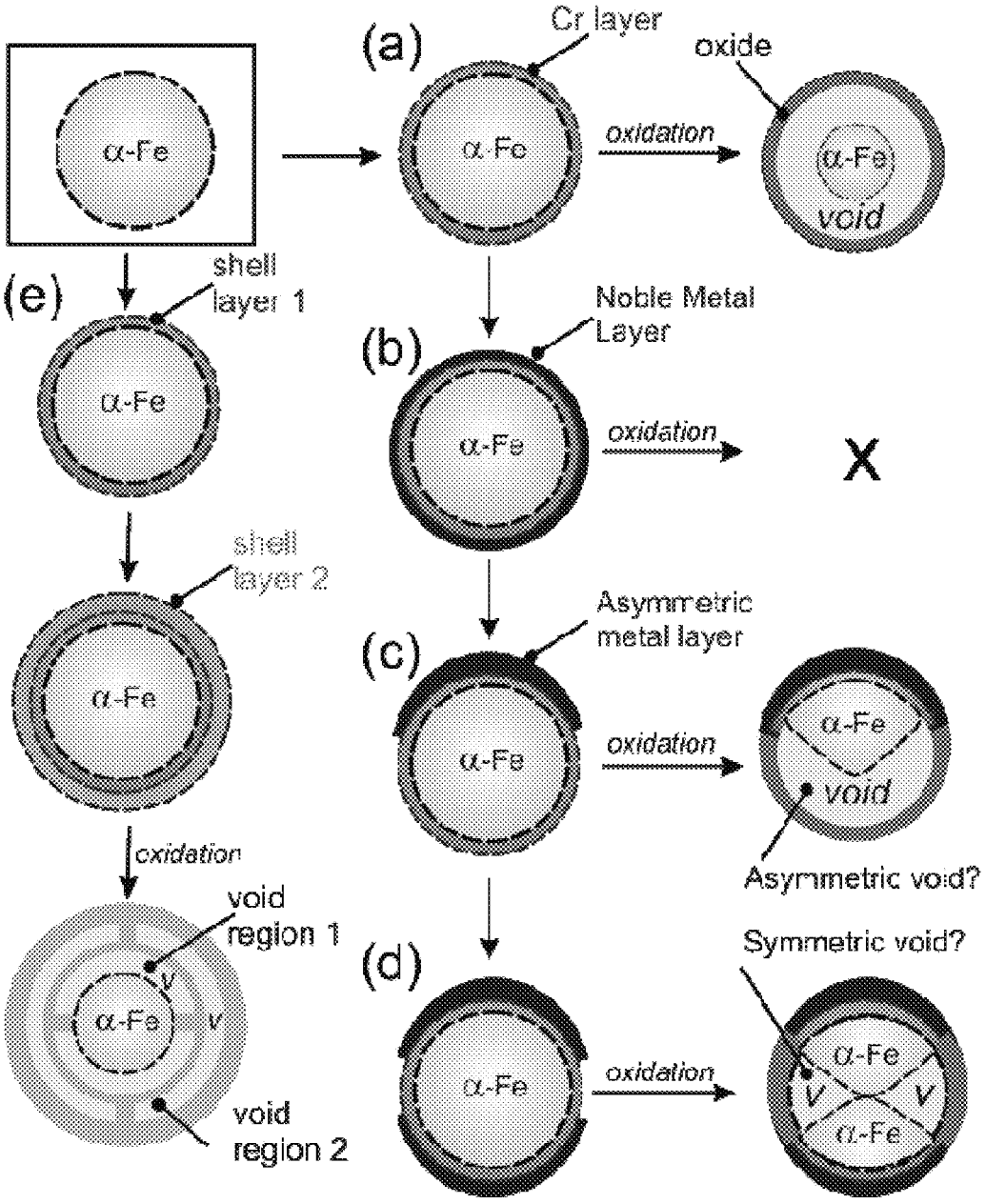

FIG. 15 is an illustration of the possible core-void-shell architectures possible using this method.

Figure 16:
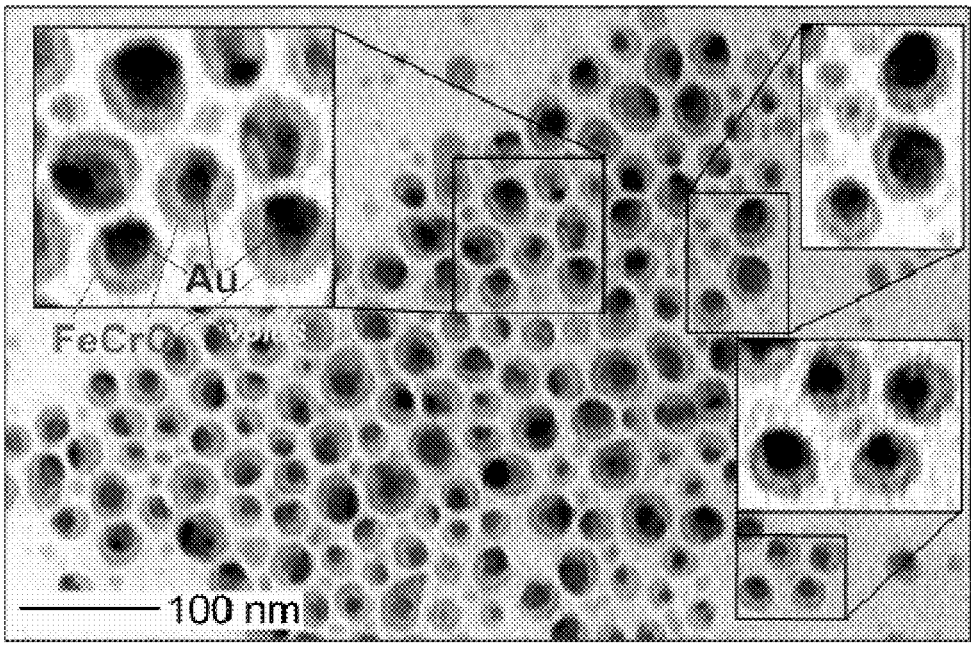

FIG. 16 is a TEM image of the Au—Fe/$Fe_xCr_{1-x}$ heterostructure after oxidation showing asymmetric voids.

Figure 17:
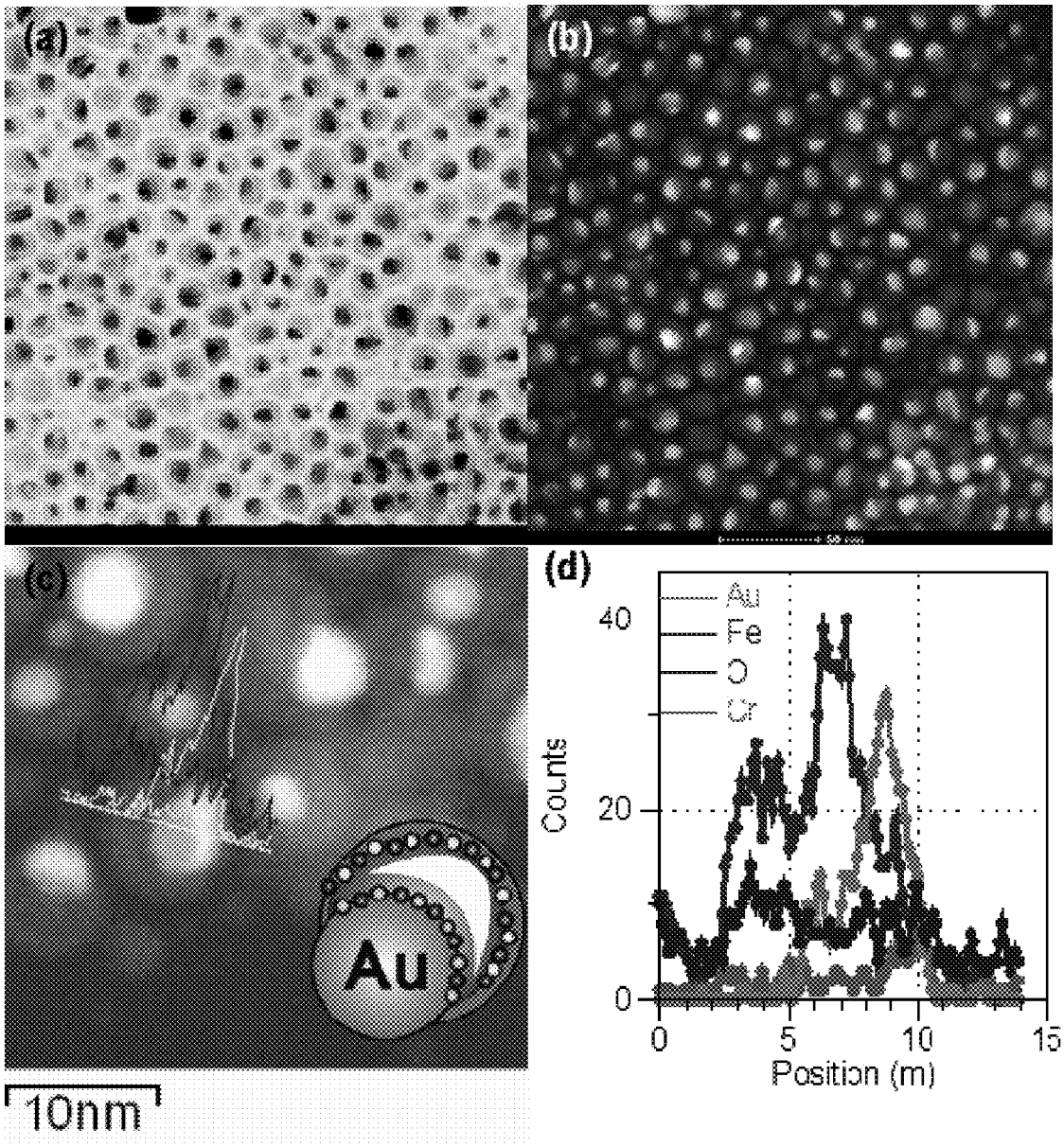

FIG. 17 is a set of STEM images in bright (a) and dark field (b) where STEM imaging reveals location of components (c-d).

Figure 18:
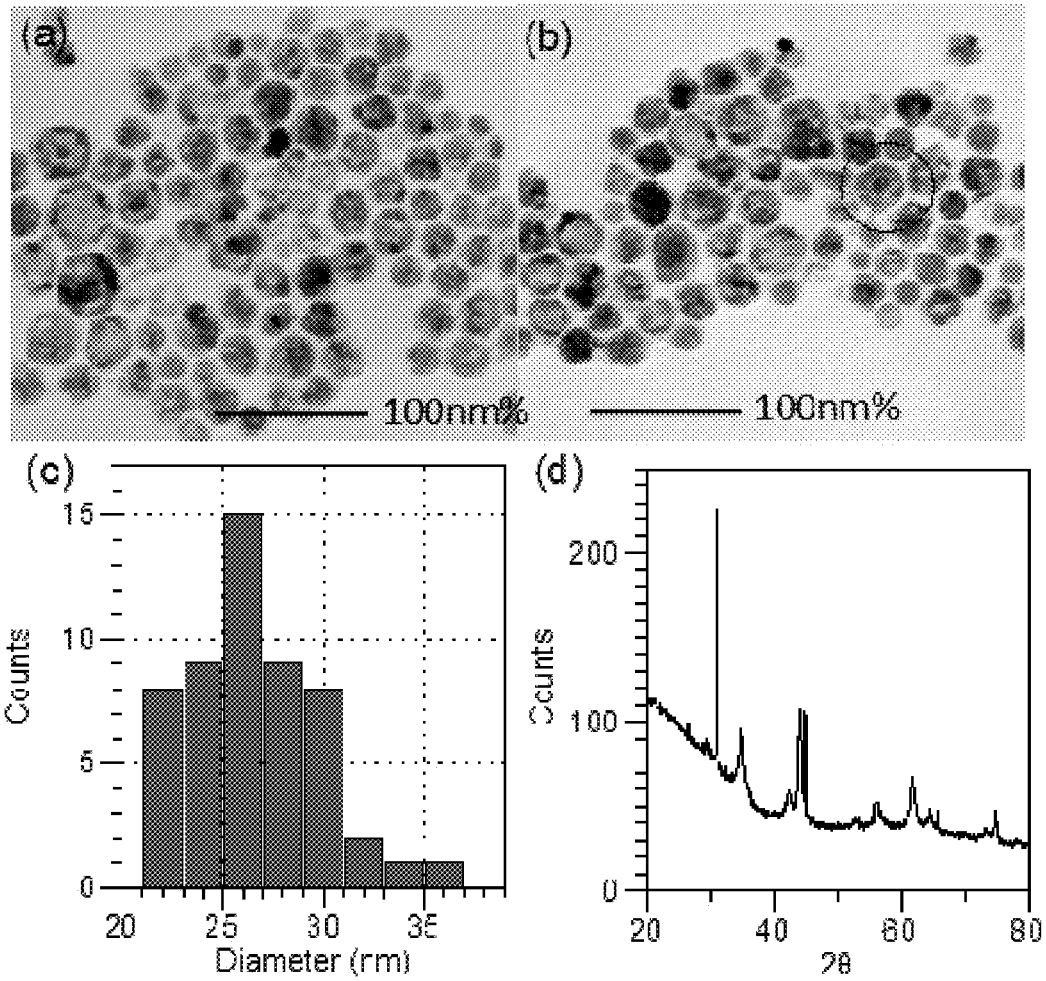

FIG. 18 shows the TEM (a-c) results after depositing copper ions into the voids of the Fe/$Fe_xCr_{1-x}$ nanoparticles followed by reduction of the ions and oxidation of the nanoparticle and (d) Powder XRD reveals signatures of a face centered cubic Cu present, confirming composition.

DETAILED DESCRIPTION OF THE INVENTION

Figure 1:
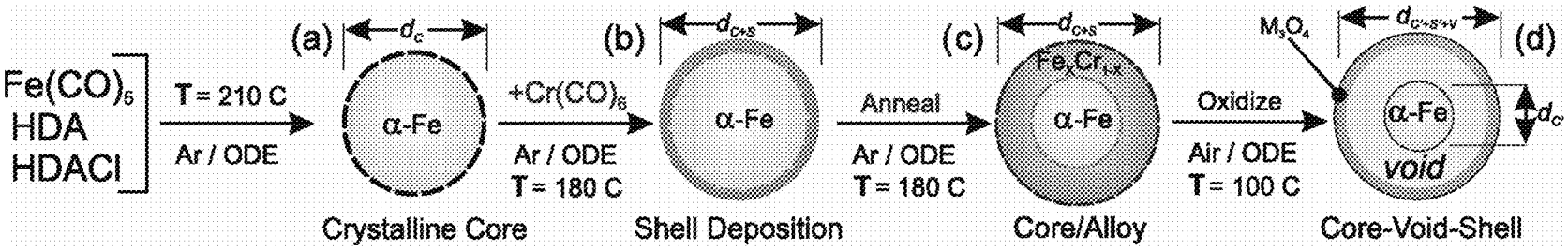
FIG. 1 is a representative transmission electron microscopy (TEM) result for the αFe core (a), the $Fe/Fe_xCr_{1_x}$ at n=16 before oxidation (b), and the same sample after oxidation in solution by opening to air at T=100° C. for 12 h.

Referring now to the drawings, wherein like reference numerals refer to like parts throughout, there is seen in FIG. 1 a schematic of the design of the present invention and the related fabrication strategy. First, iron nanoparticle (Fe) cores are synthesized via the well established thermal decomposition of $Fe(CO_5)$, with special attention is paid to using hexadecylamine chloride (HDACl) ligands to slow nucleation and growth, forming highly crystalline α-Fe, that are body centered cubic (bcc). Next, chromium shells (Cr) are deposited in a layer-by-layer process, which results in a nanometer thin shell ($t_S$). This is achieved by the step-by-step introduction of $Cr(CO)_6$ precursor at molar ratios r=[Cr $(CO)_6$]/[α-Fe] necessary to keep $t_S$~0.5 nm for each layer. This deposition is then repeated an n-number of times (n=8-16), thus allowing for the Cr-shell thickness to be tuned. The thermal decomposition deposition takes place at T=180° C. under stringent air-free conditions, with an annealing time of 0.5 h between injections. Alloying occurs at the Fe/Cr interface due to the miscibility of the metals (see FIG. 6), the promotion of alloying at the nanoscale, and the thermal annealing steps. The resulting Fe/FexCr1-x core/alloy NP having a composition (x) is determined by the amount of Cr deposited and the extent of the alloying.

Figure 2:
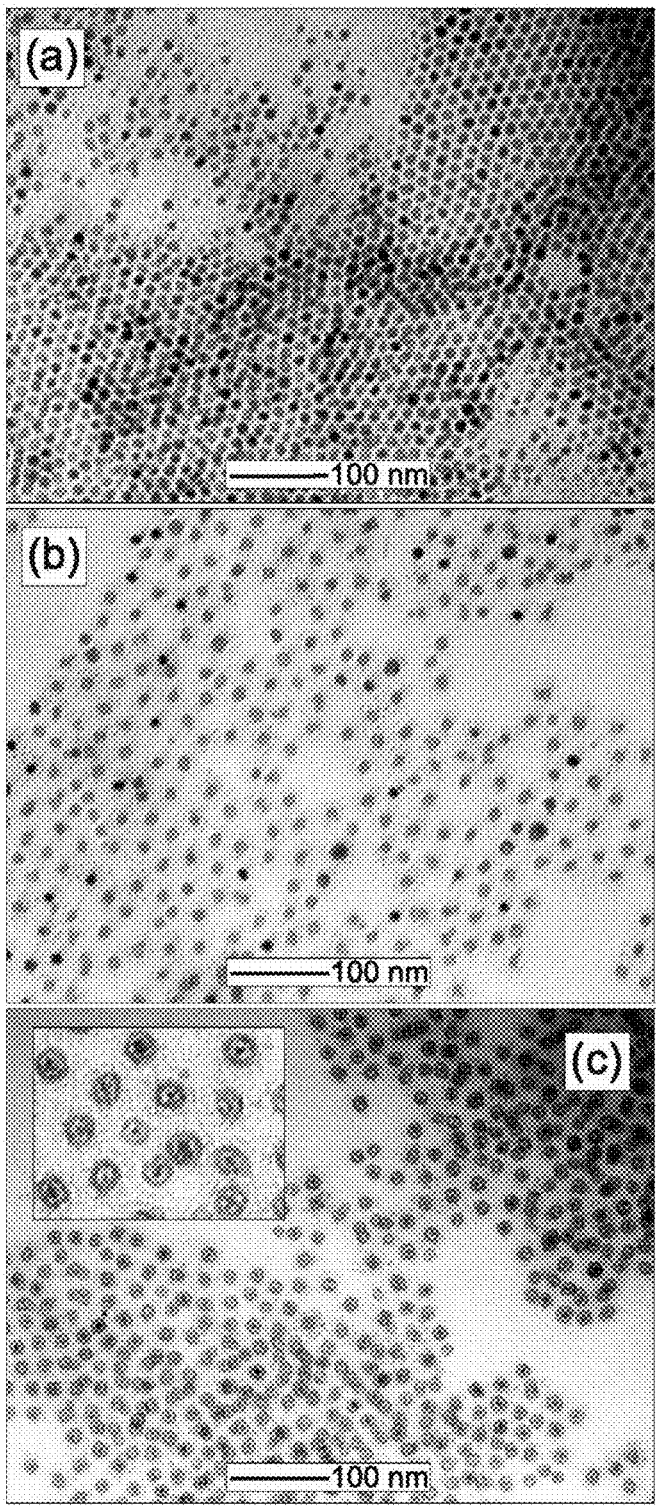
FIG. 2 is a series of representative TEM for the (a) α-Fe core (dC=13.2±1.0 nm), (b) Fe/Cr (n=16) without exposing to air ($d_{C+S}$=15.1±1.5 nm), (c) Fe/Cr (n=16) after oxidation in air at T=100° C., 12 h ($d_{C'}$=5.6±1.1 nm, $d_{C'+V+S}$=15.3±1.3 nm)

The propensity of the Fe/FeCr NPs to oxidize was studied and followed via TEM, XRD, XPS, and magnetic measurements. FIG. 2 shows a representative transmission electron microscopy (TEM) result for the α-Fe core (a), the Fe/$Fe_xCr_{1-x}$ at n=16 before oxidation (b), and the same sample after oxidation in solution by opening to air at T=100° C. for 12 h. The HDA/HDACl-capped α-Fe NP are shown to be highly uniform in size and morphology, with a core diameter of dc=13.2±1.0 nm (FIG. 2*a*). It was found to be highly crystalline, with an α-bcc crystal structure, as shown by powder X-ray diffraction (XRD) in FIG. 3*a-i*. A characteristic of this structure is the strong <110> reflection observed at 2θ=44.67°. The intensity of the <100> plane indicates its highly crystalline nature, which was further substantiated by Sheerer analysis of the $FWHM_{<110>}$, that resulted in a calculated grain size D≈13 nm. The α-Fe NP also possessed a strong superparamagnetic magnetic property, which is well known for ferromagnetic materials in this size regime (FIG. 3*a-ii*). After the Cr shell was deposited to n=16, and the resulting core+shell diameter ($d_{C+S}$) increased to $d_{C+S}$=15.1±1.5 nm, indicating the deposition of shell with $t_S$≈1 nm. This thickness was lower than the ideal estimate based on the supplied feed ratio of $Cr(CO)_6$, indicating the poor efficiency of deposition, likely due to the volatility and poor solubility of $Cr(CO)_6$, as has been described recently. The XRD results indicated the Fe/Cr NP remains highly crystalline, with the <100> reflection shifting slightly to 2θ=44.2° suggesting Fe—Cr alloying (FIG. 3*a-ii*, insets). Magnetic measurements also confirmed the deposition of the thin antiferromagnetic shell of Cr by measuring a decrease in magnetization and a slight increase in coercivity, as shown in FIG. 3*b-ii*. Further evidence for Cr deposition was provided by XPS, which confirmed the presence of Cr, and resulted in a total composition of $Fe_{93}Cr_7$, as seen in Table 1 below.

TABLE 1

XPS composition analysis of core, core/alloy, and core-void-shell morphologies shown in FIG. 2.

| | Fe[a] Core | | Fe/FexCr$_{1-x}$[b] Core/Alloy | | Fe/$M_3O_4$[c] Core-void-Shell | |
|---|---|---|---|---|---|---|
| | Pos. | At % | Pos. | At % | Pos. | At % |
| Fe (2p) | 710 | 100 | 710 | 93.0 | 711 | 88.4 |
| Cr (2p) | — | 0 | 577 | 7.0 | 577 | 11.6 |

where [a] as-synthesized core, [b] after Cr shell deposition and annealing, and [c] after oxidation.

Up to this point in the synthesis, care was paid to limit oxidation of the surface, however the Cr-shelled sample was found to be much more readily oxidized than the α-Fe core. This is best shown by the reflections that appear in the XRD that are consistent with a thin shell of $Fe_3O_4$ oxide (FIG. 3*b-i*), even though the Fe core itself largely resisted oxidation during XRD measurement (FIG. 3*a-i*). This is expected, due to the lower reduction potential of the Cr rich interface compared to Fe.

After purification via both magnetic separation as well as non-solvent precipitation, the HDA/HDACl-capped Fe/$Fe_xCr_{1-x}$ NPs were oxidized by opening the colloidal NP solutions to air at T=100° C. in ODE. Upon oxidation, an interesting phenomenon emerged. First, the NPs lost some magnetic propensity, as first monitored qualitatively via a rare earth magnet. Second, upon TEM analysis a morphological change from a solid NP to one with a distinct core, surrounded by an area of decreased contrast, and then a thin shell of increased contrast, was observed. This core-void-shell morphology is shown in FIG. 1*c*. These NPs were highly uniform in terms of the internal morphology, with a high population (>99%) possessing clear core-void-shell morphologies. Interestingly, the overall diameter of the NP remained similar to that before oxidation, with a new core+void+shell diameter size of $d_{C'+V+S}$=15.3±1.3 nm. The size of the α-Fe core decreased to $d_{C'}$=5.6 nm±1.0 nm. The XRD of the sample is shown in FIG. 2*a-ii*, and indicates the growth of an $M_3O_4$ oxide (M=Fe, Cr). The core remained highly crystalline, as observed by the preserved α-Fe <110> reflection, however its intensity was much decreased when compared to the primary the oxide reflection <113>. The smaller core also resulted in broader peaks, of which the Sheerer equation in general agreement with the TEM trend ($D_{110}$≈10 nm) (inset FIG. 3*c*), whereas the width of the oxide <113> suggests grain sizes of $D_{113}$≈4 nm. The core-void-shell structure also maintained a considerable magnetism, albeit decreased due to the now antiferromagnetic $M_2O_3$ oxide shell (FIG. 3*c-ii*). Exposure of the Fe/$Fe_xCr_{1-x}$ NPs to air while dry on the TEM grid also resulted in core-void-shell morphologies, however void size was considerably less (see FIG. 6).

The presence of Cr within the final core-void-shell structure was probed by high resolution TEM (HRTEM) with compositional analysis by scanning TEM (STEM) and selective area EDX. FIG. 4*a* shows a HRTEM for an additional batch of core-void-shell NPs prepared analogously to that shown in FIG. 2*c*. The synthesis again resulted in highly uniform morphology (a), and analysis by STEM/EDX (b) revealed an overall composition of $Fe_{87}Cr_{13}$. A similar ratio was determined across multiple regions of the TEM grid, suggesting uniform compositions throughout, and the lack of individual Fe or Cr NPs. The slightly higher concentration of Cr is likely the result of either an increase in $Cr(CO)_5$ deposition yield, or the depletion of Fe during oxidation (see below). In control experiments that subject the identical α-Fe NP core to oxidation without the Cr-layer resulted in either the well-known formation of $Fe_3O_4$ NPs at elevated temperatures (see FIG. 9*a*), or a very small percentage of the $Fe_3O_4$ with hollow morphologies, as has been reported previously (FIG. 9*c*). However no large scale core-void-shell transformation was observed, thus suggesting the importance of the Cr-shell in this morphology.

In order to further study the oxidation process and void formation, the solution containing the oxidizing NPs was sampled over the course of oxidation. FIG. 4 shows a set of TEM micrographs from aliquots collected at T=100° C. and annealing times of 2.5 (a), 5.0 (b), 7.5 (c), and 10 h (d). Each sample revealed a very similar core-void-shell morphology, the dimensions of which are summarized in the histograms (FIG. 5) and in Table 2 below.

TABLE 2

TEM determined dimension at the four-oxidation stages of Fe/$Fe_xCr_{1-x}$ NPs shown in FIG. 5 originating from cores with diameter of $d_C$ = 15.8 ± 2.6 nm

| Time (h)[a] | $d_{c'+v+s}$ (nm)[b] | $d_{c'+v}$ (nm)[c] | $d_{c'}$ (nm)[d] |
|---|---|---|---|
| 2.5 | 17.7 ± 2.4 | 12.1 ± 2.0 | 8.9 ± 1.6 |
| 5 | 16.7 ± 1.9 | 12.3 ± 1.4 | 8.7 ± 1.3 |
| 7.5 | 16.8 ± 2.1 | 12.3 ± 1.9 | 8.7 ± 1.9 |
| 10 | 16.5 ± 1.8 | 11.6 ± 1.6 | 7.8 ± 1.5 |

where [a] oxidation time at 100° C., [b] diameter of new core+void+shell ($d_{C'+V+S}$), [c] diameter of new core+void ($d_{C'+V}$), and [d] diameter of new core ($d_{C'}$).

This particular batch of NPs had a slightly more polydisperse α-Fe core ($d_C$=15.8±2.6 nm), and thus the final core-void-shell NPs adopt similar dispersity. Interestingly, these results indicate that the oxidation process has seemingly reached completion after only a few hours (~2.5). Similar conclusions were made by XRD analysis of each aliquot (see FIG. 8), which revealed the retention of the α-Fe core in the presence of the oxide shell over the course of the annealing. These results are intriguing because it shows that the void-formation reaches a quick completion, and that the final structure is not a hollow NP, of which has been observed in a number of oxidation systems, such as CoO and Fe NPs. Finally, these core-void-shell NPs were observed to be highly stable, and showed no morphological changes over the course of months (either in solution or on TEM grid). In addition, they remain colloidially stable in non-polar solvents, and retain the HAD/HDACl-capping throughout the process, as observed by FTIR and TGA (see FIGS. 14*a*, 14*b*).

The observed structural transformation of these α-Fe/$Fe_xCr_{1-x}$ NPs to ones with a core-void-shell morphology with a considerable amount of open space is best explained using a modified vacancy coalescence mechanism, which is influenced by both chemical and morphological factors. For instance, the α-Fe cores prepared here are highly crystalline, with a non-closed packed bcc crystal structure, which inherently has a 68% packing density. Moreover, as the $Fe_xCr_{1-x}$ alloys phase diagram suggests, an α-structure is expected at x=0.1-1.0 (see FIG. 6), and since no other reflections were observed after addition of the Cr-shell, this structure is expected to remain during shell deposition and alloying. In contrast, the oxides of Fe can be varied (i.e., α-, γ-$Fe_2O_3$, $Fe_3O_4$) whereas that of Cr is well defined (i.e. $Cr_2O_3$), and each has a more close-packed structure, thus limiting further oxidation. Moreover, the diffusivity of both the Fe and Cr atoms are many orders of magnitude higher than $O^{2-}$ anions. This non-reciprocal diffusion leads to the vacancy coalescence mechanism that has been shown for the oxidation of Co NPs by either $O^{2-}$ or $S^{2-}$. In those systems, diffusion of Co to the surface, where it is oxidized, results in hollow NPs as a result of the rapid diffusion outwards of Co and the slowing internalization of $O^{2-}$, leaving vacancies at the Co/oxide interface, which coalesce into nanoscopic voids.

It has also been shown that when a Pt/Co core/shell NP is used, that the Co shell will undergo oxidation, whereas the Pt cannot, resulting in what is referred to as a core-yolk-shell NP, a particular morphology that is the closest in the literature to the nanostructures shown here. In that case, it is easy to understand that oxidation will stop at the Pt interface, due to its resistance to oxidation. However, it is less clear as to why the oxidation stops in the system of the present invention, as evidenced by the crystalline α-Fe core shown in XRD and TEM. Clearly, it is related to the contribution of the Cr-rich interface's oxidation, its thickness, and the temperature and the time of oxidation. In bulk stainless steel (~$Fe_{84}Cr_{16}$) for instance, the addition of Cr acts as a passivating layer, which upon oxidation, limits further $O^{2-}$ transport, due to the stability of the $Cr_2O_3$ oxide and its lattice constant (a=2.88 Å) being similar to α-Fe and α-Cr. However, in the current system, the shell adopts a $M_3O_4$ crystal structure (M=Fe, Cr), and no $Cr_2O_3$ (or $Fe_2O_3$) was detected. A $CrFe_2O_4$ structure has precedent in the literature, and its likely that this form arises due to the known stability of the $M_3O_4$ structure at the nanoscale, particularly for low temperature oxidation, and the alloying of the interface, which is high in Fe content (i.e. thin Cr shell). A main difference of the present invention compared to say, bulk stainless steel, is that oxidation is not driven by electrochemical or acid means, and this may further limit the accessibility of the $Cr_2O_3$ lattice. A second factor is the relative thickness of the Cr-shell, as this influences Fe transport, oxide thickness, and the resulting electron tunneling behavior. A close inspection of the core-void-shell morphologies (see FIG. 2*c*, FIG. 4, FIG. 5), shows a bridge connecting the core and shell, which provide both the electrical and atom transport to the tunneling at the interface.

To support this, control studies with thinner Cr shells (n=8, FIG. 8), were found to result in similar core-void-shell morphologies, while in contrast, thicker, more Cr-rich shells (n=8-16, FIGS. 12-13), showed limited void formation, and improved resistance to oxidation. Finally, an additional factor here is the modest temperatures employed during oxidation (T=100° C.). The low temperature oxidation of Fe NPs has been studied previously, and both the self diffusivity of atoms, as well as the ability of the electrons to tunnel the oxidation barrier is closely linked by temperature. Thus, our vacancy coalescence mechanism can also be considered a low temperature example. This was further substantiated by performing oxidation at elevated temperatures (T=200° C.), in which smaller α-Fe cores were observed, with high populations of entirely hollow particles, or broken NP debris, showing that the system can be forced to completion (see FIG. 1).

Additional versions of this approach include the use of multiple alloy or metallic layers which have different propensity for oxidation, which will lead to multiple layers and domains of voids as well as asymmetric nanoparticles in which noble metals are deposited in specific locations of the NP, thus influencing oxidation and void growth, as seen in FIG. 15. FIG. 16 shows a TEM micrograph for an Au—Fe/$Fe_xCr_{1-x}$ heterostructure after oxidation, in which a Au-layer was first deposited onto the Fe/$Fe_xCr_{1-x}$, and oxidation was carried out as described previously. The areas of high contrast (dark) are the gold nanoparticle regions, which have a hollow void located in close proximity, followed by a thin oxide shell. The voids are asymmetric in nature, and in contrast to the ones shown previously of the isotropic Fe/$Fe_xCr_{1-x}$ cores, demonstrating the potential structures that can be made via this method. FIG. 17 shows a HRTEM/STEM image of these asymmetric voids, with areas of gold and Fe/Cr clearly defined.

In addition, the voids of these materials could be filled with a new element. Using the Fe/$Fe_xCr_{1-x}$, core-void-shell particles, copper ions could be inserted into the voids which, when followed by reduction and oxidation, leads to a new core-void-shell nanostructure. FIG. 18 shows the morphology of Fe/Cr/Au core/alloy NP after oxidation in which a larger particle size is observed and distinct cracks or pores can be observed in addition to new voids in the morphology. Analysis via XRD revealed diffraction of copper face centered cubic (FCC) planes, confirming the presence of the metal in the nanostructure.

Taken together, these results demonstrate a novel synthetic pathway to tailor the internal microstructure of nanomaterials. The methodology used here that results in core-void-shell morphologies may be translated to other systems in which the interface composition and thickness is used as a synthetic tool to alter Kirkendall effects and as a result, final internal morphology. Given the recent utility of these classes of nanomaterials in an array of applications, such as in gas storage and heterogeneous catalysis, as well as lithium ion batteries, more work is needed to achieve the full synthetic control and potential.

EXAMPLE

Chemicals

Iron(0)pentacarbonyl (Fe(CO)5, 99.5%), Chromium(0) hexacarbonyl (Cr(CO)6, 98%), Oleylamine (OAm, 70%), 1-Octadecene (ODE, 90%), Tetrahydrofuran (THF, anhydrous, 99.9%, inhibitor-free), Hexadecylamine (HDA, 98%), HCl (1.0 M in diethylether), $HAuCl_4.xH_2O$ (99.999% trace metals basis), 1,2-hexadecanediol (technical grade, 90%), $Cu(acac)_2$ (≥99.99% trace metals basis), $HAuCl_4.xH_2O$ (99.999% trace metals basis), 1,2-hexadecanediol (technical grade, 90%), $Cu(acac)_2$ (≥99.99% trace metals basis) were purchased from Sigma-Aldrich and used as received.

Synthesis

HDA.HCl Ligand: The HDA.HCl ligand was synthesized by adding an excess amount HCl in diethylether (12 mL, 1.0 M) was added into a solution of 10 mmol of hexadecylamine (HDA) (2.44 g) in 100 mL of hexanes that was pre-cooled in an ice bath. The white precipitate was formed and the reaction mixture was warmed up to room temperature and was stirred for 2 h before the solution was decanted and the precipitate was washed for 3 times with hexanes. After evaporation of hexanes, 1.8 g (66% yield) of HDA.HCl was obtained.

Synthesis of Au/Fe core, Fe/Cr/Au & Fe/Cr/Au oxide: Oleic acid (2 mmol), oleylamine (2 mmol), 70 mg of HDA HCl 1,2-hexadecandiol (5 mmol) and 10 ml 1-octadecene (ODE) were mixed and stirred under a gentle flow of nitrogen at 120° C. for 20 min. Then under a blanket of nitrogen, the degassed gold precursor solution consisting of 17 mg HAuCl4 (0.05 mmol), 0.25 ml oleylamine (0.75 mmol) and 2.5 ml ODE was injected into the solution. After 2 min, 0.15 ml Fe(CO)5 (1 mmol) was injected into the solution. The solution turned to dark red instantly after the injection, indicating the formation of gold nanoparticles. The mixture was heated to reflux (~310° C.) for 45 min, cooled down to room temperature. Cr shell was deposited using the same fashion using THF as the solvent for 1 hr, and then the Fe/Cr/Au NP was subjected to the same oxidation condition for 5 hrs. The particles were precipitated out with iso-propanol (~40 ml) addition followed by centrifugation. The precipitate was re-dispersed into hexane in the presence of ~0.05 ml oleylamine and centrifuged again to remove any undispersed materials. The dumbbell nanoparticles were precipitated out by adding ethanol and re-dispersed in hexane in the presence of ~0.05 ml oleylamine, giving a dark red brown dispersion. A little extra of oleylamine was necessary to ensure long term stability of the dispersion.

Synthesis of Cu/Fe/Cr oxide Nanoparticles: 28.3 mg of as synthesized Fe/FexCr1-x core-void-shell structure was re-dispersed in 10 ml Oam, 0.25 mmol of (65 mg) Cu(acac)2 was added as Cu precursor with 1 mmol (258.44 mg) of 1,2-hexadecanediol (HHD) as a reducing agent, the solution was heated up to 160° C. and stayed for 2 h before cooled down to room temperature, the NP was processed using ethanol and hexane washing cycle.

α-Iron Nanoparticle core (α-Fe): The crystalline α-Fe nanoparticles were prepared via the thermal decomposition of Fe(CO)5 in the presence of oleylamine (OAm), and hexadecylammonium chloride (HDA.HCl). In a typical experiment, 20 mL of octadecene (ODE) with 139 mg of HDA.HCl, and 0.15 mL of Oleylamine (OAm) was heated to 120° C. and degassed for 0.5 h, then the solution was heated to 180° C., and 0.35 mL of Fe(CO)5 was injected to the solution under an Ar blanket. The color of the solution changed from yellow to brown then black within 20 min, which is slower than the decomposition of Fe(CO)5 without the existence of HDA.HCl. The resulting α-Fe NPs showed high magnetism, and because of this the final synthesis proceeded without a stir bar to avoid precipitation, but was bubbled with Ar to ensure mixing. After 30 min of annealing at 180° C., a 10 mL aliquot was collected and stored at under Ar, while the rest was used as the cores for shell deposition. After 30 min, a 10 mL of the Fe NP solution with concentration of 1.28 mM was added with ethanol to precipitate the product. After centrifugation (10 min, 4400 RPM), the NPs were re-dispersed in hexane and precipitated by ethanol, this same procedure was repeated one more time and the final product was dispersed in hexane and stored in Ar.

Chromium Shell Deposition and Annealing at Fe Cores (α-Fe/FeCr): In a typical synthesis, 650 mg Cr(CO)6 was dissolved in 20 mL of hot ODE (100° C.) and added into a solution of α-Fe NPs cores under Ar at 180° C. in a layer-by-layer fashion. For instance, a 1 mL aliquot was injected at each layer (n) to achieve minimum Cr shell coating with theoretical 0.25 nm shell thickness growth provided complete dissolution of the Cr precursor, then annealed for 15 min before adding additional shells (up to n=8 or n=16 in this study). Similar to above, during shell growth no stir bar was added to avoid any inference from the magnetic field produced. The total annealing time for a typical shell deposition is ~4 hrs. Ethanol was added to precipitate the product. After centrifugation (10 min, 4400 RPM), the product was re-dispersed in hexane and precipitated by ethanol, this same procedure was repeated one more time and the final product was dispersed in hexane and stored in Ar. Alternatively, the $Cr(CO)_6$ was first dissolved in THF and used as the shell precursor. This method improved control of shell growth. Briefly, in a typical synthesis, 650 mg $Cr(CO)_6$ was dissolved in 20 mL of warm THF (35° C.) and added into a solution of α-Fe NPs cores under Ar at 180° C. in a layer-by-layer fashion. Shell deposition was then carried out similarly to that described above.

Oxidation and formation of core-void-shell Morphology: The oxidation of the α-Fe/FeCr experiment was conducted using the NPs in the mother liquor that had been opened up to air under heating at 100° C. in a silicon oil bath. During oxidation, aliquots were collected for TEM, XPS, and magnetic measurements. After oxidation, the NPs were purified as described above.

Synthesis of Au—Fe/FeCr heterostructures & asymmetric voids: Oleic acid (2 mmol), oleylamine (2 mmol), 70 mg of HDA HCl, 1,2-hexadecandiol (5 mmol) and 10 ml 1-octadecene (ODE) were mixed and stirred under a gentle flow of nitrogen at 120° C. for 20 min. Then under a blanket of nitrogen, the degassed gold precursor solution consisting of 17 mg $HAuCl_4$ (0.05 mmol), 0.25 ml oleylamine (0.75 mmol) and 2.5 ml ODE was injected into the solution. After 2 min, 0.15 ml $Fe(CO)_5$ (1 mmol) was injected into the solution. The solution turned to dark red instantly after the injection, indicating the formation of gold nanoparticles. The mixture was heated to reflux (~310° C.) for 45 min, cooled down to room temperature. Cr shell was deposited using the same fashion using THF as the solvent for 1 hr, and then the Fe/Cr/Au NP was subjected to the same oxidation condition for 5 hrs. The particles were precipitated out with iso-propanol (~40 ml) addition followed by centrifugation. The precipitate was re-dispersed into hexane in the presence of ~0.05 ml oleylamine and centrifuged again to remove any undispersed materials. The dumbbell nanoparticles were precipitated out by adding ethanol and re-dispersed in hexane in the presence of ~0.05 ml oleylamine, giving a dark red brown dispersion. A little extra of oleylamine was necessary to ensure long term stability of the dispersion.

Backfilling voids with copper and oxidation: 28.3 mg of as synthesized $Fe/Fe_xCr_{1-x}$ core-void-shell structure was re-dispersed in 10 ml OAm, 0.25 mmol of (65 mg) $Cu(acac)_2$ was added as Cu precursor with 1 mmol (258.44 mg) of 1,2-hexadecanediol (HHD) as a reducing agent, the solution was heated up to 160° C. and stayed for 2 h before cooled down to room temperature, the NP was processed using ethanol and hexane washing cycle.

Instrumentation

UV-Vis spectrophotometry (UV-Vis): The UV-Vis measurements were collected on a Varian Cary100 Bio UV-Vis spectrophotometer between 200 and 900 nm. The instrument is equipped with an 8-cell automated holder with high precision Peltier heating controller.

Transmission electron microscopy (TEM): TEM measurements were performed on a JEOL 2000EX instrument operated at 100 kV with a tungsten filament (SUNY-ESF, N.C. Brown Center for Ultrastructure Studies). HRTEM measurements were performed on either a FEI T12 Twin TEM operated at 120 kV with a LaB6 filament and Gatan Orius dual-scan CCD camera or a FEI T12 Spirit TEM STEM operated at 120 kV equipped with a EDAX Genisis X-ray detector (Cornell Center for Materials Research). Particle size and aspect ratio were analyzed manually with statistical analysis performed using ImageJ software on populations of at least 100 counts.

Powder X-ray diffraction (XRD): Powder XRD patterns were taken on a Bruker D8 Advance powder diffractometer using Cu Kα radiation (k=1.5406 Å). The diffraction (Bragg) angles 2θ were scanned at a step of 0.04° with a scan speed of 40 s/step. Samples were deposited as dry powder on glass slides.

X-ray Photoelectron Spectroscopy (XPS): XPS also known as electron spectroscopy for chemical analysis (ESCA) measurements were performed on Surface Science Instruments (SSI) model SSX-100 that utilizes monochromated Aluminum K-α x-rays (1486.6 eV) to strike the sample surface (Cornell Center for Materials Research). The analysis depth was ~5 nm at an emission angle of 55°. The data was processed using CasaXPS software. The NP powders were dispersed on freshly cleaved HOPG substrates for analysis.

Magnetization Measurement: The magnetic measurement was conducted on Quantum Design Physical Property Measurement System (PPMS) in Cornell Center of Materials Research, PPMS consists of a 9 Tesla superconducting magnet in a helium dewar with sample temperature range of 1.9-400K.

What is claimed is:

1. A nanoparticle, comprising layers of:

an iron core;

a chromium alloy shell forming having an outer oxide interface layer rich in chromium;

a void between said iron core and said chromium alloy shell; and a metal positioned between the iron core and shell and at least partially filling the void;

wherein the diameter of said nanoparticle is between about 15 and 25 nanometers.

2. The nanoparticle of claim 1, wherein said metal is a noble metal.

3. The nanoparticle of claim 1, wherein said chromium shell comprises a plurality of layers of chromium.

4. The nanoparticle of claim 1, wherein the outer oxide layer comprises M3O4, wherein M comprises iron and chromium.

5. The nanoparticle of claim 1, wherein said nanoparticle is characterized by a lack of morphological changes over the course of a plurality of months.

6. The nanoparticle of claim 1, A nanoparticle, comprising layers of:

an iron core;

a chromium alloy shell forming having an outer oxide interface layer rich in chromium;

a void between said iron core and said chromium alloy shell; and a metal positioned between the iron core and shell and at least partially filling in the defined void;

wherein the final diameter of said iron core is between about 6 and 9 nanometers.

7. The nanoparticle of claim 1, wherein said nanoparticle is magnetic.

8. The nanoparticle of claim 1, wherein said void is symmetric.

9. The nanoparticle of claim 1, wherein said void is asymmetric.

10. A method of forming the nanoparticle of claim 1, comprising the steps of:

providing an iron core;

depositing a chromium shell onto said iron core;

annealing at high temperature forming an iron-chromium interface between core and shell;

oxidizing said nanoparticle to form at least one void between said shell and said core; and at least partially filling the at least one void with a metal.

11. The method of claim 10, further comprising the step of annealing said chromium shell to said iron core prior to oxidizing said nanoparticle.

12. The method of claim 10, wherein the step of depositing a chromium shell onto said iron core comprises sequentially depositing a plurality of layers of chromium onto said iron core.

13. The method of claim 10, wherein said at least one void comprises multiple voids having a plurality of sizes and a plurality of layers.

* * * * *